US006278233B1

(12) United States Patent
Sanou et al.

(10) Patent No.: US 6,278,233 B1
(45) Date of Patent: Aug. 21, 2001

(54) IMAGE FORMING APPARATUS WITH SPACER

(75) Inventors: Yoshihisa Sanou, Atsugi; Hideaki Mitsutake, Yokohama; Yoichi Ando, Inagi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/056,814

(22) Filed: Apr. 8, 1998

(30) Foreign Application Priority Data

Apr. 11, 1997 (JP) ..... 9-094109
Mar. 27, 1998 (JP) ..... 10-082051

(51) Int. Cl.[7] ..... H01J 1/62; H01J 63/04; H01J 1/88; H01J 19/42; H01J 1/18

(52) U.S. Cl. ..... 313/495; 313/292; 313/336; 313/351; 313/496; 313/497

(58) Field of Search ..... 313/292, 253, 313/256, 268, 309, 310, 336, 351, 495–97; 315/366, 169.3; 220/445

(56) References Cited

U.S. PATENT DOCUMENTS

| | | | |
|---|---|---|---|
| 4,904,895 | 2/1990 | Tsukamoto et al. | 313/336 |
| 5,066,833 | 11/1991 | Zalenski | 178/19 |
| 5,770,918 | 6/1998 | Kawate et al. | 313/495 |

FOREIGN PATENT DOCUMENTS

| | | |
|---|---|---|
| 0721195A1 | 7/1996 | (EP) . |
| 0739029A2 | 10/1996 | (EP) . |
| 64-31332 | 2/1989 | (JP) . |
| 2-257551 | 10/1990 | (JP) . |
| 3-55738 | 3/1991 | (JP) . |
| 4-28137 | 1/1992 | (JP) . |
| 97-3354 | 1/1997 | (KR) . |

OTHER PUBLICATIONS

M.I. Elinson, et al., "The Emission of Hot Electrons and the Field Emission of Electrons from Tin Oxide", Radio Engineering and Electronic Physics, vol. 10, Jul., 1965, pp. 1290–1296.

G. Dittmer, "Electrical Conduction and Electron Emission of Discontinuous Thin Films", Thin Solid Films, vol. 9, (1972), pp. 317–328.

M. Hartwell, et al., "Strong Electron Emission from Patterned Tin–Indium Oxide Thin Films", IEEE Trans. ED Conf., (1975), pp. 519–521.

H. Araki, et al., "Electroforming and Electron Emission of Carbon Thin Films", Journal of the Vacuum Society of Japan, vol. 26, No. 1, Jan. 1983, pp. 22–29.

W.P. Dyke, et al., "Field Emission", Advances in Electronics and Electron Physics, vol. 8, (1956), pp. 89–185.

C.A. Spindt, et al., "Physical Properties of Thin–Film Field Emission Cathodes with Molybdenum Cones", J. Appl. Phys., vol. 47, No. 12, Dec. 1976, pp. 5248–5263.

C.A. Mead, "Operation of Tunnel–Emission Devices", J. Appl. Phys., vol. 32, No. 4, Apr. 1961, pp. 646–652.

*Primary Examiner*—Ashok Patel
*Assistant Examiner*—Mack Haynes
(74) *Attorney, Agent, or Firm*—Fitzpatrick, Cella, Harper & Scinto

(57) ABSTRACT

An image forming apparatus such as an image display apparatus has spacers the charging of the surface of which can be reduced as well as the occurrence of discharge. The image forming apparatus includes an envelope, an electron source disposed within the envelope, an image forming member for forming an image by irradiation with electrons emitting by the electron source, and a spacer disposed between electrodes to which mutually different voltages are applied within the envelope. The spacer has conductivity and is electrically connected to the electrodes via conductive layers, and each of the conductive layers has an end portion defining a shape which is a combination of a linear portion and a curved portion or a combination of a linear portion and an obtuse-angle portion.

19 Claims, 23 Drawing Sheets

FIG. 14A
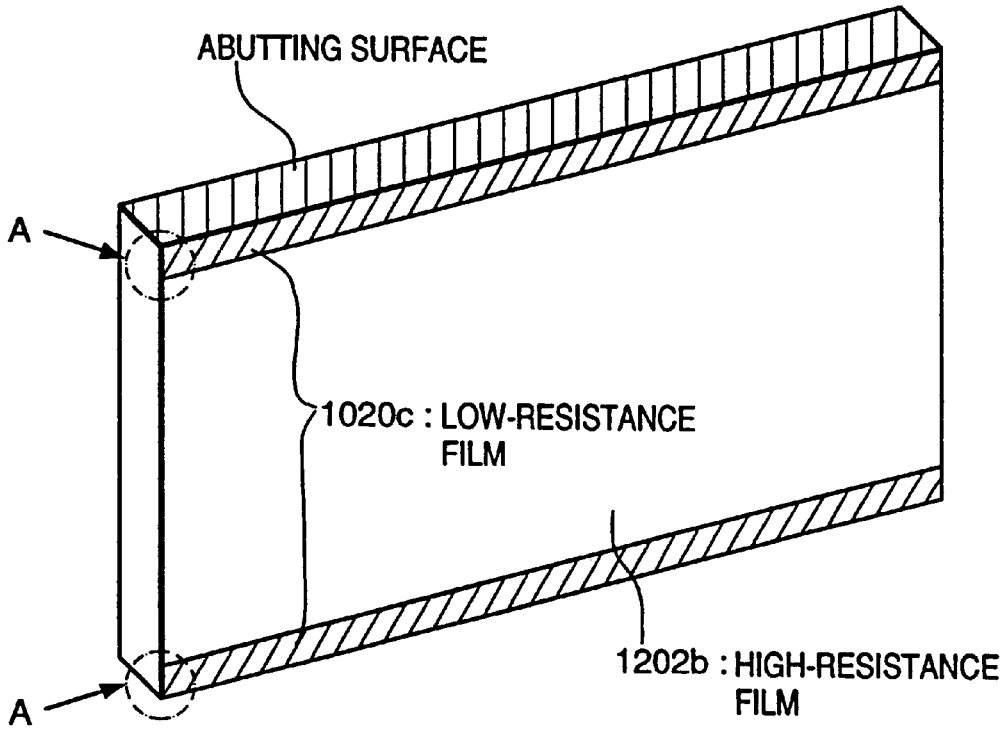
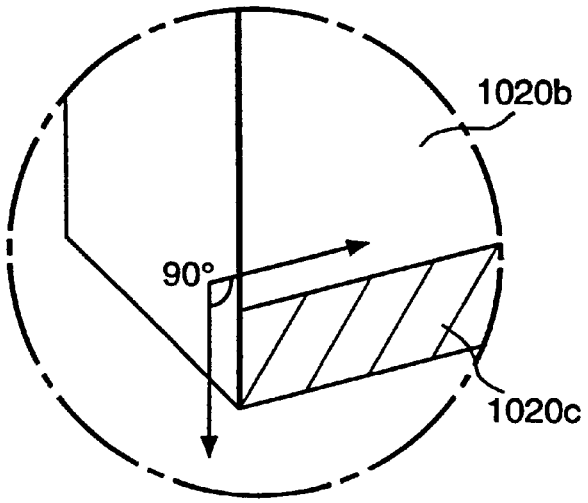
FIG. 14B

FIG. 14C
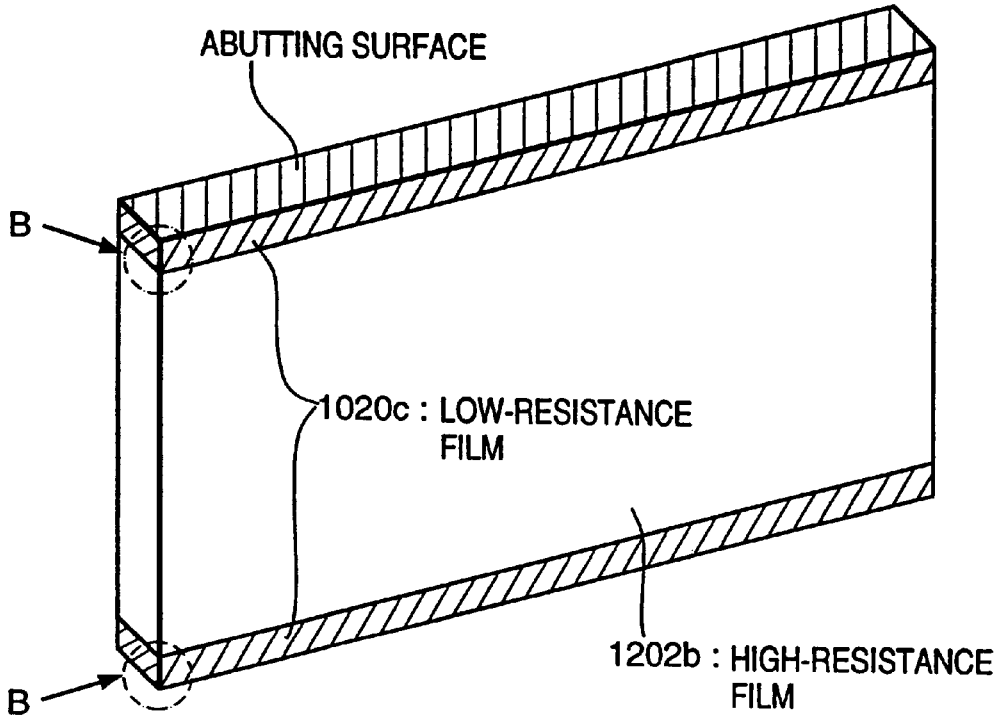
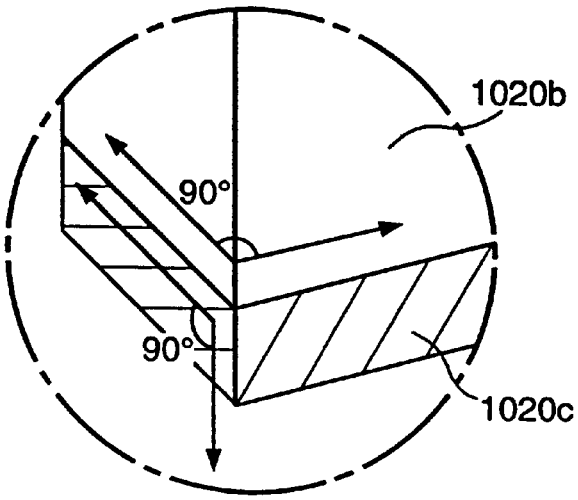
FIG. 14D

FIG. 15A
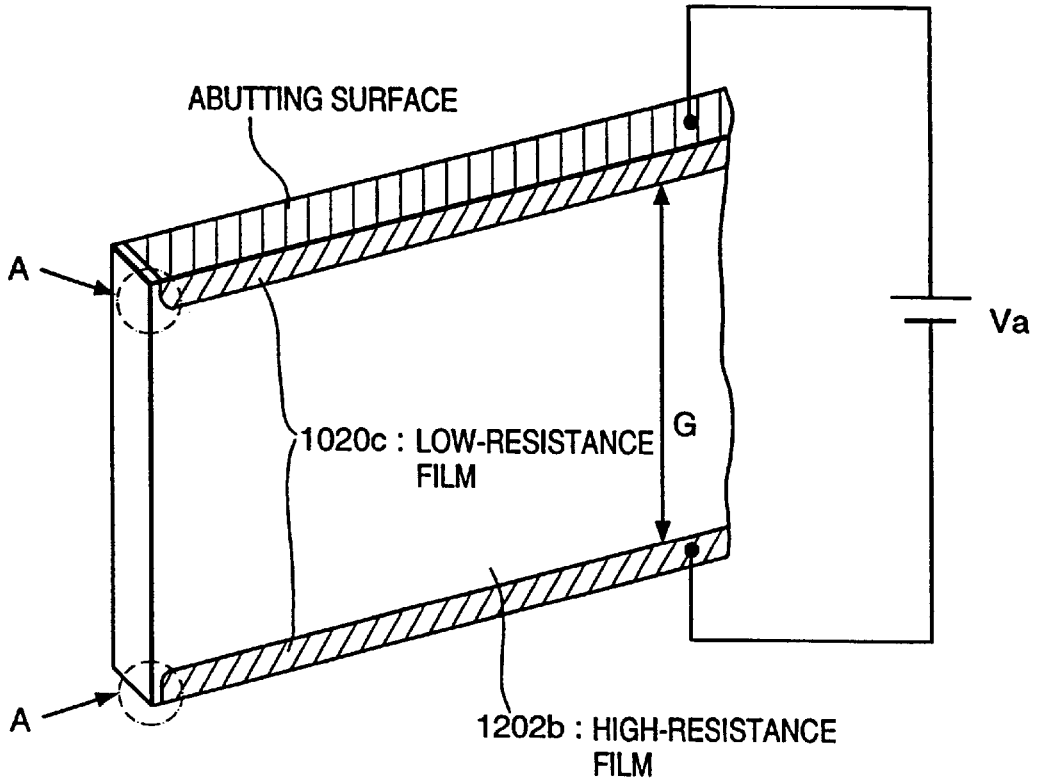
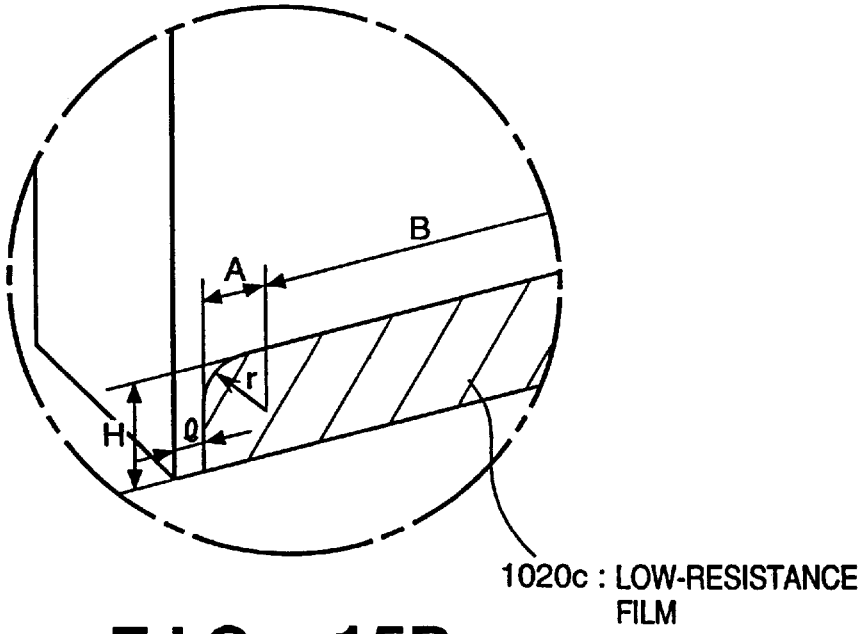
FIG. 15B

IMAGE FORMING APPARATUS WITH SPACER

BACKGROUND OF THE INVENTION

1. Field of the Invention

This invention relates to an image forming apparatus such as an image display apparatus using an electron source.

2. Description of the Related Art

Two types of elements, namely hot cathode elements and cold cathode elements, are known as electron emission elements for constructing the electron sources mentioned above. Examples of cold cathode elements are surface-conduction electron emission elements, electron emission elements of the field emission type (abbreviated to "FE" below) and metal/insulator/metal type (abbreviated to "MIM" below).

An example of the surface-conduction electron emission element is described by M. I. Elinson, Radio. Eng. Electron Phys., 10, 1290, (1965). There other examples as well, as will be described later.

The surface-conduction electron emission element makes use of a phenomenon in which an electron emission is produced in a small-area thin film, which has been formed on a substrate, by passing a current parallel to the film surface. Various examples of this surface-conduction electron emission element have been reported. One relies upon a thin film of $SnO_2$ according to Elinson, mentioned above. Other examples use a thin film of Au [G. Dittmer: "Thin Solid Films", 9, 317 (1972)]; a thin film of $In_2O_3/SnO_2$ (M. Hartwell and C. G. Fonstad: "IEEE Trans. E.D. Conf.", 519 (1975); and a thin film of carbon (Hisashi Araki, et al: "Vacuum", Vol. 26, No. 1, p. 22 (1983).

FIG. 17 is a plan view of the element according to M. Hartwell, et al., described above. This element construction is typical of these surface-conduction electron emission elements. As shown in FIG. 17, numeral 3001 denotes a substrate. Numeral 3004 denotes an electrically conductive thin film comprising a metal oxide formed by sputtering and is formed into a flat shape resembling the letter "H" in the manner illustrated. The conductive film 3004 is subjected to an electrification process referred to as "electrification forming", described below, whereby an electron emission portion 3005 is formed. The spacing L in FIG. 17 is set to 0.5~1 mm, and the spacing W is set to 0.1 mm. For the sake of illustrative convenience, the electron emission portion 3005 is shown to have a rectangular shape at the center of the conductive film 3004. However, this is merely a schematic view and the actual position and shape of the electron emission portion are not necessarily represented faithfully here.

In above-mentioned conventional surface-conduction electron emission elements, especially the element according to Hartwell, et al., generally the electron emission portion 3005 is formed on the conductive thin film 3004 by the so-called "electrification forming" process before electron emission is performed. According to the forming process, a constant DC voltage or a DC voltage which rises at a very slow rate on the order of 1 V/min is impressed across the conductive thin film 3004 to pass a current through the film, thereby locally destroying, deforming or changing the property of the conductive thin film 3004 and forming the electron emission portion 3005, the electrical resistance of which is very high. A crack is produced in part of the conductive thin film 3004 that has been locally destroyed, deformed or changed in property. Electrons are emitted from the vicinity of the crack if a suitable voltage is applied to the conductive thin film 3004 after electrification forming.

Known examples of the FE type are described in W. P. Dyke and W. W. Dolan, "Field emission", Advance in Electron Physics, 8,89 (1956), and in C. A. Spindt, "Physical properties of thin-film field emission cathodes with molybdenum cones", J. Appl. Phys., 47, 5248 (1976).

A typical example of the construction of an FE-type element is shown in FIG. 18, which is a sectional view of the element according to Spindt, et al., described above. The element includes a substrate 3010, emitter wiring 3011 comprising an electrically conductive material, an emitter cone 3012, an insulating layer 3013 and a gate electrode 3014. The element is caused to produce a field emission from the tip of the emitter cone 3012 by applying an appropriate voltage across the emitter cone 3012 and gate electrode 3014.

In another example of the construction of an FE-type element, the stacked structure of the kind shown in FIG. 18 is not used. Rather, the emitter and gate electrode are arranged on the substrate in a state substantially parallel to the plane of the substrate.

A known example of the MIM type is described by C.A. Mead, "Operation of tunnel emission devices", J. Appl. Phys., 32, 646 (1961). FIG. 19 is a sectional view illustrating a typical example of the construction of the MIM-type element. The element includes a substrate 3020, a lower electrode 3021 consisting of a metal, a thin insulating layer 3022 having a thickness on the order of 100 Å, and an upper electrode 3023 consisting of a metal and having a thickness on the order of 80~300 Å. The element is caused to produce a field emission from the surface of the upper electrode 2023 by applying an appropriate voltage across the upper electrode 3023 and lower electrode 3021.

Since the above-mentioned cold cathode element makes it possible to obtain an electron emission element at a lower temperature in comparison with a hot cathode element, a heater for applying heat is unnecessary. Accordingly, the structure is simpler than that of the hot cathode element and it is possible to fabricate elements that are more slender. Further, even though a large number of elements are arranged on a substrate at a high density, problems such as fusing of the substrate do not readily arise. In addition, the cold cathode element differs from the hot cathode element in that the latter has a slow response speed because it is operated by heat produced by a heater. Thus, an advantage of the cold cathode element is a quicker response speed.

For these reasons, extensive research into applications for cold cathode elements is being carried out.

By way of example, among the various cold cathode elements, the surface-conduction electron emission element is particularly simple in structure and easy to manufacture and therefore is advantageous in that a large number of elements can be formed over a large area. Accordingly, research has been directed to a method of arraying and driving a large number of elements, as disclosed in Japanese Patent Application Laid-Open No. 64-31332, filed by the applicant.

Further, applications of surface-conduction electron emission elements that have been researched are image forming devices such as image display devices and image recording devices, as well as charged beam sources, etc.

As for applications to image display devices, research has been conducted with regard to such devices using, in combination, surface-conduction type electron emission elements and phosphors which emit light in response to irradiation with an electron beam, as disclosed, for example, in the specifications of U.S. Pat. No. 5,066,833 and Japanese Patent Application Laid-Open (KOKAI) Nos. 2-257551 and 4-28137 filed by the present applicant. The image display device using the combination of the surface-conduction type electron emission elements and phosphors is expected to have characteristics superior to those of the conventional image display device of other types. For example, in comparison with a liquid-crystal display device that has become so popular in recent years, the above-mentioned image display device emits its own light and therefore does not require back-lighting. It also has a wider viewing angle.

A method of driving a number of FE-type elements in a row is disclosed, for example, in the specification of U.S. Pat. No. 4,904,895 filed by the present applicant. A planar-type display apparatus reported by Meyer et al., for example, is known as an example of an application of an FE-type element to an image display apparatus. [R. Meyer: "Recent Development on Microtips Display at LETI", Tech. Digest of 4th Int. Vacuum Microelectronics Conf., Nagahama, pp. 6~9, (1991).]

An example in which a number of MIM-type elements are arrayed in a row and applied to an image display device is disclosed in the specification of Japanese Patent Application Laid-Open Nos. 3-55738 filed by the present applicant.

Among the available image forming apparatus that use electron emission elements of the kind described above, a flat panel display apparatus, which is very slender in the depth direction, is advantageous in that it occupies little space and is light in weight. For these reasons, such a display apparatus has become the focus of attention as an alternative to a display apparatus using a cathode-ray tube.

FIG. 20 is a perspective showing an example of the display panel portion of a flat-type image display apparatus. Part of the panel has been broken away to reveal the interior structure of the apparatus.

As shown in FIG. 20, the apparatus includes a rear plate 3115, a side wall 3116 and a face plate 3117. The rear plate 3115, side wall 3116 and face plate 3117 form a hermetic envelope for maintaining a vacuum within the display panel.

The substrate 3111 is fixed to the rear plate 3115 and N×M cold cathode elements 3112 are formed on the substrate. (N, M are positive integers having a value of two or greater, with the number being set appropriately in conformity with the number of display pixels intended.) The M×N cold cathode elements 3112 are wired by M-number of row-direction wiring patterns 3113 and N-number of column-direction wiring patterns 3114, as shown in FIG. 20. The portion constituted by the substrate 3111, cold cathode elements 3112, row-direction wiring patterns 3113 and column-direction wiring patterns 3114 is referred to as a "multiple electron beam source". Further, an insulating layer (not shown) is formed between the wiring patterns at least at the portions where the row-direction wiring patterns 3113 and column-direction wiring patterns 3114 intersect. This is to maintain the electrical insulation between the wiring patterns.

A phosphor film 3118 comprising phosphors is formed on the underside of the face plate 3117. Portions of the phosphor film 3118 are coated with individual phosphors (not shown) of the three primary colors red (R), green (G) and blue (B) Further, a black body (not shown) is provided between the individual color phosphors constituting the phosphor film 3118. A metal back 3119 comprising aluminum or the like is provided on the side of the phosphor film 3118 facing the rear plate 3115.

Electrical connection terminals Dx1~Dxm, Dy1~Dyn and Hv having an air-tight structure are provided to electrically connect the display panel to an electric circuit, which is not shown. The terminals Dx1~Dxm are electrically connected to the row-direction wiring patterns 3113 of the multiple electron beam source, the terminals Dy1~Dyn are electrically connected to the column-direction wiring patterns 3114 of the multiple electron beam source, and the terminal Hv is electrically connected to the metal back 3119.

The interior of the hermetic envelope is maintained at a vacuum on the order of $1\times10^{-6}$ torr. An increase in the display area of the image display apparatus gives rise to the need for means for preventing deformation or breakage of the rear plate 3115 and face plate 3117 caused by a difference in air pressure between the interior and exterior of the hermetic envelope. A method that relies upon thickening of the rear plate 3115 and face plate 3116 not only increases the weight of the image display apparatus but also causes image deformation or parallax when the image is viewed from an oblique angle. By contrast, in FIG. 20, structural supports (referred to as "spacers" or "ribs") 3120 each comprising a comparatively thin glass plate for withstanding atmospheric pressure are provided. In this manner a gap usually on the order of less than one millimeter to several millimeters is maintained between the substrate 3111 on which the multiple electron beam source has been formed and the face plate 3166 on which the phosphor film 3118 has been formed, and the interior of the hermetic envelope is kept at a high vacuum.

When voltage is applied to each of the cold cathode elements 3112 through the external terminals Dx1~Dxm, Dx1~Dyn of the envelope in the image display apparatus using the above-described display panel, each of the cold cathode elements 3112 emits electrons. At the same time, a high voltage on the order of several hundred volts to several kilovolts is applied to the metal back 3119 through the external terminal Hv of the envelope, whereby the emitted electrons are accelerated and bombard the inner surface of the face plate 3117. As a result, the phosphors of the various colors constituting the phosphor film 3118 are excited into emitting light to display an image.

The display panel of the above-described image display apparatus has a number of problems, set forth below.

First, there is the possibility that the spacer 3120 will develop a charge owing to the fact that some of the electrons emitted from the vicinity of the spacer 3120 strike the spacer or the fact that ions produced by the ionizing effect of the emitted electrons attach themselves to the spacer. The paths of the electrons emitted by the cold cathode elements 3112 are caused to bend by the charge on the spacer and the electrons therefore arrive at locations on the phosphors that are different from the normal positions. As a consequence, the image in the vicinity of the spacer is displayed is distorted fashion.

Second, since a high voltage greater than several hundred volts (namely a strong electric field greater than 1 kV/mm) is impressed across the multiple electron beam source and the face plate 3117 in order to accelerate the electrons emitted by the cold cathode elements 3112, there is the danger that a surface discharge will occur on the surface of the spacer 3120. In a case where the spacer develops a charge in the manner described above, especially there is the possibility that a discharge will be induced.

In order to solve these problems, it has been proposed to eliminate the charge by arranging it so that a very small current flows into the spacer. To this end, a high-resistance film is formed on the surface of an insulating spacer, whereby a very small current flows on the surface of the spacer. The film used for preventing the spacer from being charged is a thin film of tin oxide, a mixed-crystal thin film of tin oxide and indium oxide, or an island-like metal film. Further, in order to enhance the function of the film used for preventing the spacer from being charged, it has been contemplated to dispose a conductive film on the surface of the spacer 3120 that contacts the substrate 3111 or the phosphor film 3118 and in the vicinity thereof. It is expected that this will assure an electrical connection between the film used for preventing the spacer from being charged and the substrate 3111 and between the film used for preventing the spacer from being charged and the phosphor film 3118.

However, if the conductive film has a projecting or angular shape, concentration of an electric field will occur when a high voltage is impressed across the substrate 3111 and face plate 3117. This may become a cause of discharge. As a result, a problem which arises is that the cold cathode elements 3112 are caused to deteriorate, making it difficult to form an image. If the voltage applied across the substrate 3111 and face plate 3117 is lowered in order to suppress such discharge, sufficient brightness can no longer be obtained.

SUMMARY OF THE INVENTION

Accordingly, an object of the present invention is to provide a spacer the charging of the surface of which can be reduced as well as the occurrence of discharge, and an image forming apparatus having such spacers.

According to the present invention, the foregoing object is attained by providing an image forming apparatus comprising: an envelope; an electron source disposed within the envelope; an image forming member for forming an image by irradiation with electrons emitting by the electron source; and a spacer disposed between electrodes to which mutually different voltages are applied within the envelope; the spacer having conductivity and being electrically connected to the electrodes via conductive layers; each of the conductive layers having an end portion defining a shape which is a combination of a linear portion and a curved portion or a combination of a linear portion and an obtuse-angle portion.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 14A and 14C are diagrams illustrating examples of the shapes of projections of a low-resistance film (intermediate layer) and FIGS. 14B and 14D are enlargements of the areas A and B shown in FIGS. 14A and 14C, respectively;

FIG. 15A is a diagram for describing the shape of a low-resistance film according to this embodiment and FIG. 15B is an enlargement of the area A shown in FIG. 15A;

DESCRIPTION OF THE PREFERRED EMBODIMENTS

Figure 1:
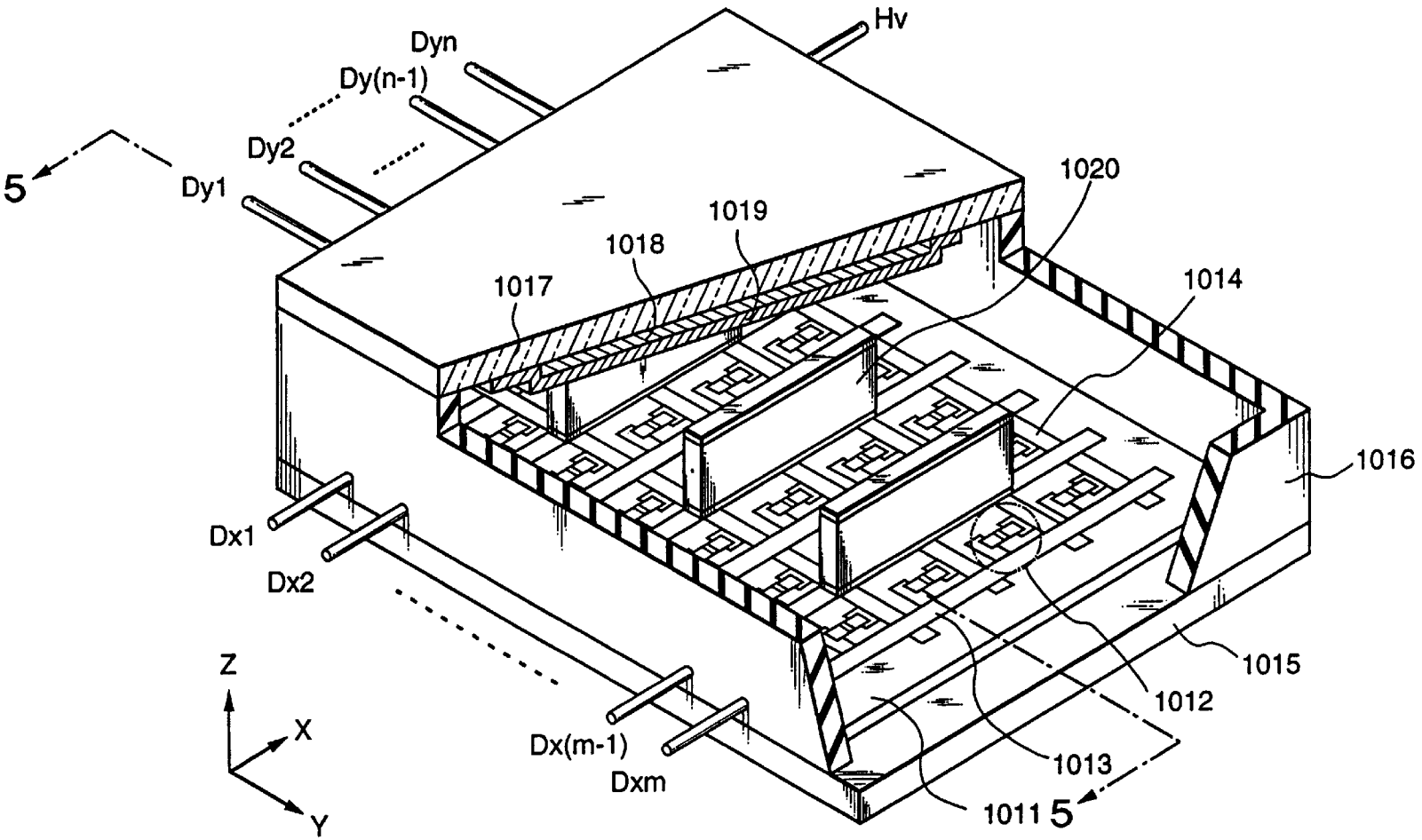
FIG. 1 is a perspective view of a display panel used in an embodiment of the present invention.

Preferred embodiments of the present invention will be described below with reference to the accompanying drawings.

An overview of the embodiments will be explained before describing them in detail.

Assume that the above-described arrangement has been adopted, namely that in which the above-mentioned conductive film (also referred to as an "intermediate layer" below) is disposed on the support member (spacer) in the vicinity of the portions where the spacer contacts the side of the image forming member and the side of the element substrate. In such case, the following phenomena occur if the boundary between the intermediate layer and a high-resistance film, described later, has a shape that causes an intense concentration of electric field:

(1) When voltage is applied to the image forming member, an electric discharge is produced at locations where the electric field has been concentrated by the intermediate layer. The higher the voltage applied to the image forming member, and the stronger the concentration of the electric field, the more frequently this discharge phenomenon occurs.

(2) As a result, image quality declines owing to degradation of the electron sources in the vicinity of the locations of the discharge. In addition, limiting the voltage applied to the image forming member in order to prevent the discharge phenomenon invites a decline in brightness.

The inventors have devised the following measures to eliminate these difficulties: Specifically, a support member for withstanding atmospheric pressure is placed between electrodes to which different voltages are applied within the hermetically sealed envelope of the electron beam generating device. The support member includes an insulating member the surface of which is covered with a film exhibiting conductivity but having a resistance higher than that of the electrodes. This high-resistance film is electrically connected between both of the electrodes via low-resistance films (intermediate layers) whose resistance is lower than that of the high-resistance film. The edge of the low-resistance film preferably is composed of a combination of linear portions and a curved portion or a combination of linear portions and an obtuse-angle portions.

Thus, the support member (spacer) of the electron beam generating device according to this embodiment has a surface provided with a high-resistance film electrically connected to an electrode on the substrate side and to an electrode on the side of the phosphor film via the low-resistance films. As a result, even if charged particles attach themselves to the surface of the insulating member, the charged particles are electrically neutralized with some of the current that flows through the high-resistance film via the low-resistance film (e.g., a metal film), thereby making it possible to neutralize the charge on the spacer. Since the low-resistance film of metal is placed over the major portion of the connection between the high-resistance film and the element substrate side or between the high-resistance film and the side of the image forming member, as set forth above, a stabilized current is supplied. As a result, charging can be prevented, thereby making it possible to prevent a deviation in light emitting position.

Furthermore, the concentration of electric field can be suppressed by providing the edge portion of the low-resistance film with an external shape that is a combination of straight lines and a curve having a large curvature or a combination of straight lines and portions defining obtuse angles. According to this embodiment, it is possible to apply a higher voltage across image forming member and element substrate while suppressing discharge due to the presence of the spacer.

By virtue of the above-described structure, it is possible to realize an excellent image of improved brightness, ascribed to application of higher voltage, in which there is no shift in light emitting position in an image forming apparatus.

This embodiment will now be described in greater detail.

(1) Overview of image display apparatus

The construction of the display panel of an image display apparatus, as well as a method of manufacturing the panel, according to this embodiment of the present invention will now be described.

FIG. 1 is a perspective view of the display panel used in this embodiment. Part of a panel is broken away to reveal the internal structure of the apparatus.

The apparatus includes a rear plate 1015, a side wall 1016 and a face plate 1017. The rear plate 1015, side wall 1016 and face plate 1017 form a hermetic envelope for maintaining a vacuum within the display. panel. In terms of assembling the hermetic vessel, the joints between the members require to be sealed to maintain sufficient strength and air-tightness. By way of example, a seal is achieved by coating the joints with frit glass and carrying out calcination in the atmosphere or in a nitrogen environment at a temperature of 400~500° C. for 10 min or more. The method of evacuating the interior of the hermetic vessel will be described later. Further, the interior of the hermetic envelope is maintained at a vacuum on the order of $1\times10^{-6}$ torr. Accordingly, spacers 1020 are provided as structures, which are capable of withstanding atmospheric pressure, for the purpose of preventing damage to the hermetic envelope caused by atmospheric pressure or inadvertent impact.

A substrate 1011 is fixed to the rear plate 1015, which substrate has n×m cold cathode elements 1012 formed thereon. (Here n, m are positive integers having a value of two or greater, with the number being set appropriately in conformity with the number of display pixels intended. For example, in a display apparatus the purpose of which is to display high-definition television, it is desired that the set numbers of elements be no less than n=3000, m=1000.) The n×m cold cathode elements are matrix-wired by m-number of row-direction wiring patterns 1013 and n-number of column-direction wiring patterns 1014. The portion constituted by the components 1011~1014 is referred to as a "multiple electron beam source".

There is no limitation upon the material, shape or manufacturing process of the cold cathode elements so long as the multiple electron beam source used in the image display apparatus of this embodiment is an electron beam source obtained by wiring the cold cathode elements in the form of a simple matrix. Accordingly, cold cathode elements of surface-conduction electron emission elements or the FE or MIM type can be used.

Described next will be the structure of a multiple electron beam source obtained by arraying surface-conduction electron emission elements (described later) on a substrate as cold cathode elements and wiring the elements in the form of a simple matrix.

Figure 2:
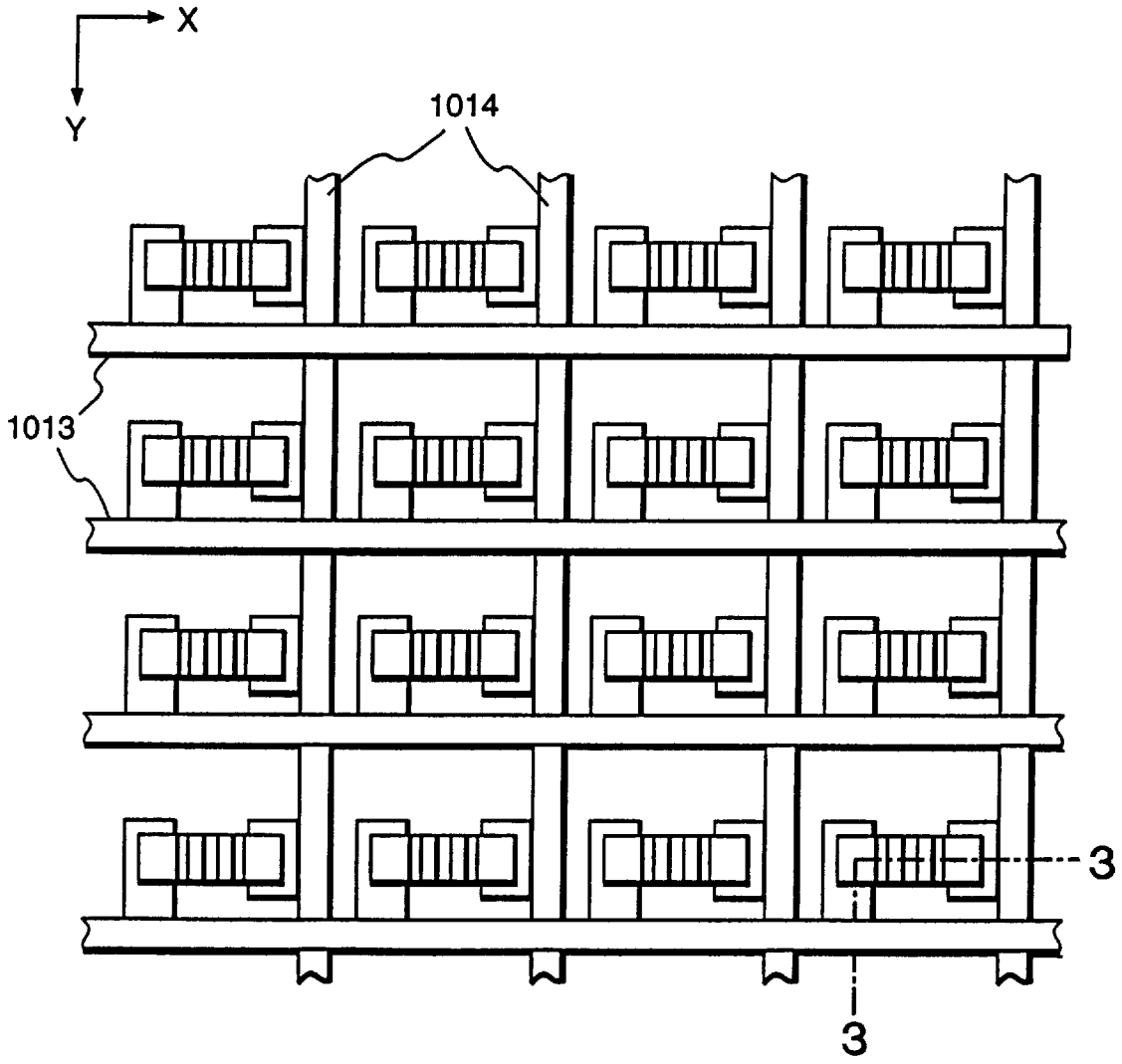
FIG. 2 is a plan view of a multiple electron beam source used in the display panel of FIG. 1.

FIG. 2 is a plan view of the multiple electron beam source used in the display panel of FIG. 1. Here surface-conduction electron emission elements similar to the type shown in FIG. 6 (described later) are arrayed on the substrate 1011 and these elements are wired in the form of a simple matrix by the row-direction wiring electrodes 1013 and column-direction wiring electrodes 1014. An insulating layer (not shown) is formed between the electrodes at the portions where the row-direction wiring electrodes 1013 and column-direction wiring electrodes 1014 intersect, thereby maintaining electrical insulation between the electrodes.

Figure 3:
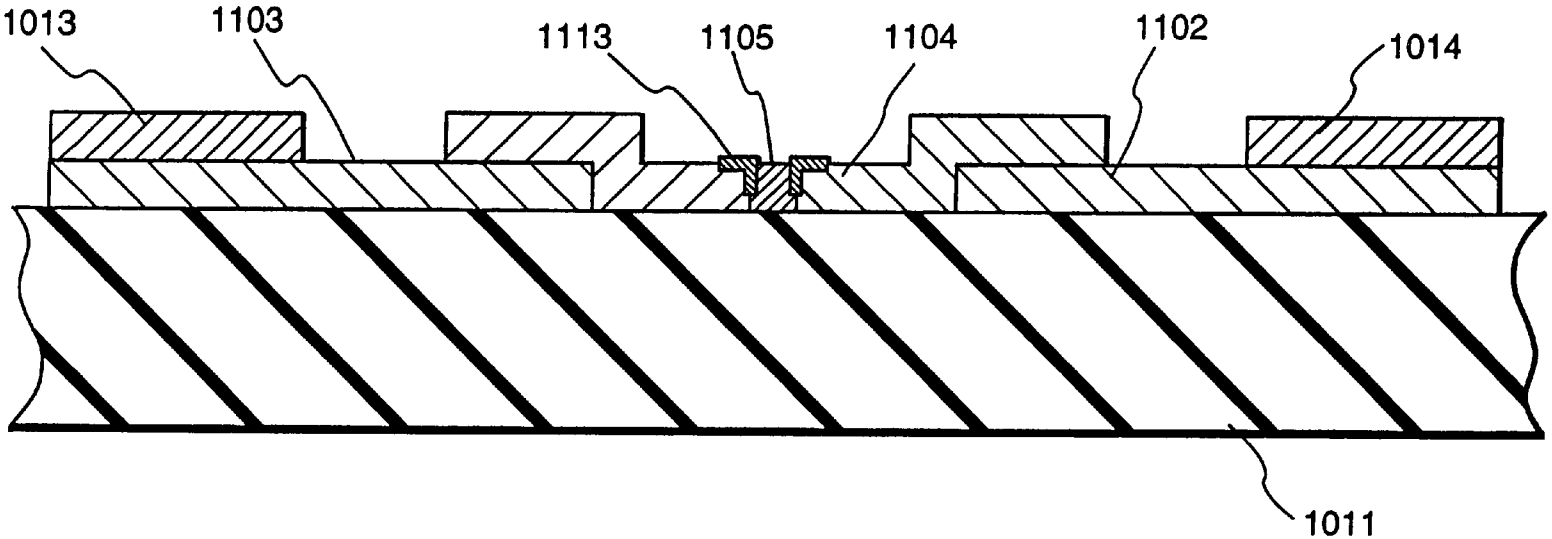
FIG. 3 is a sectional view taken along line 3—3 in FIG. 2.

FIG. 3 is a sectional view taken along line 3—3 of FIG. 2.

It should be noted that the multiple electron source having this structure is manufactured by forming the row-direction wiring electrodes 1013, column-direction wiring electrodes 1014, inter-electrode insulating layer (not shown) and the element electrodes and electrically conductive thin film of the surface-conduction electron emission elements on the substrate in advance, and then applying an electrification forming treatment (described later) and an electrification activation treatment (described later) by supplying current to each element via the row-direction wiring electrodes 1013 and column-direction wiring electrodes 1014.

In this embodiment, the structure is such that the substrate 1011 of the multiple electron beam source is fixed to the rear plate 1015 of the hermetic envelope. However, in a case where the substrate 1011 of the multiple electron beam source has sufficient mechanical strength, the substrate 1011 may itself be used as the rear plate of the hermetic envelope.

Figure 4A:
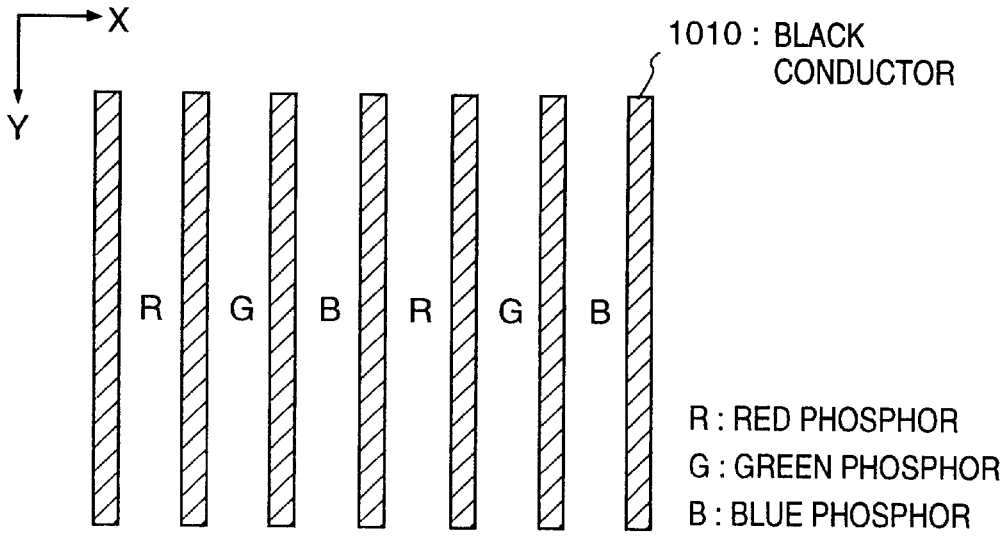
FIGS. 4A and 4B are diagrams showing the patterns of phosphor films.

A phosphor film 1018 is formed on the underside of the face plate 1017. Since this embodiment relates to a color display apparatus, portions of the phosphor film 1018 are coated with phosphors of the three primary colors red, green and blue used in the field of CRT technology. The phosphor of each color is applied in the form of stripes, as shown in FIG. 4A, and a black conductor 1010 is provided between the phosphor stripes. The purpose of providing the black conductors 1010 is to assure that there will not be a shift in the display colors even if there is some deviation in the position irradiated with the electron beam, to prevent a decline in display contrast by preventing the reflection of external light, and to prevent the phosphor film from being charged up by the electron beam. Though the main ingredient used in the black conductor 1010 is graphite, any other material may be used so long as it is suited to the above-mentioned objectives.

Figure 4B:
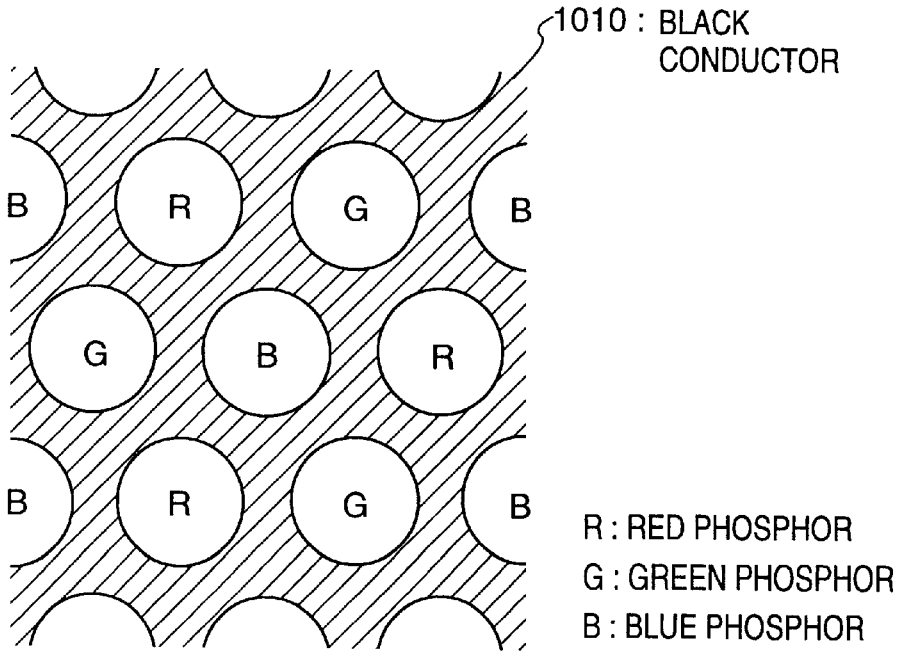

The application of the phosphors of the three primary colors is not limited to the stripe-shaped array shown in FIG. 4A. For example, a delta-shaped array, such as that shown in FIG. 4B, or other array may be adopted.

In a case where a monochromatic display panel is fabricated, a monochromatic phosphor material may be used as the phosphor film 1018 and the black conductor material need not necessarily be used.

Further, a metal back 1019 well known in the field of CRT technology is provided on the surface of the phosphor film 1018 on the side of the rear plate. The purpose of providing the metal back 1019 is to improve the utilization of light by reflecting part of the light emitted by the phosphor film 1018, to protect the phosphor film 1008 against damage due to bombardment by negative ions, to act as an electrode for applying an electron-beam acceleration voltage, and to act as a conduction path for the electrons that have excited the phosphor film 1018. The metal back 1019 is fabricated by a method which includes forming the phosphor film 1018 on the face plate substrate 1017, subsequently smoothing the surface of the phosphor film and vacuum-depositing aluminum on this surface. In a case where a phosphor material for low voltages is used as the phosphor film 1018, the metal back 1019 is unnecessary.

Though not used in this embodiment, transparent electrodes made of a material such as ITO may be provided between the face plate substrate 1017 and the phosphor film 1018 in order to apply an accelerating voltage and for the purpose of improving the conductivity of the phosphor film 1018.

Figure 5:
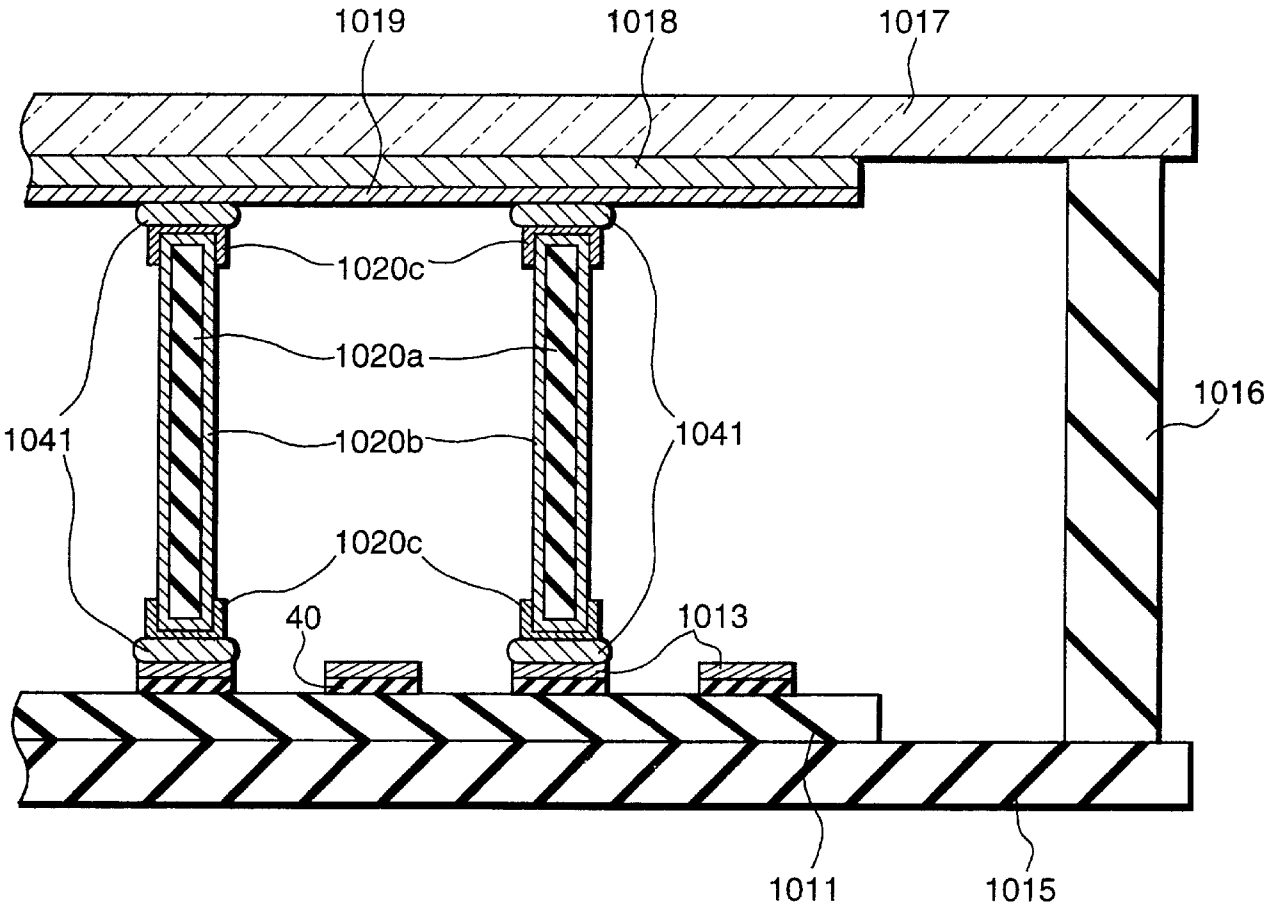
FIG. 5 is a sectional schematic view taken along line 5—5 in FIG. 1.

FIG. 5 is a sectional view of FIG. 1 taken along line 5—5 of FIG. 1. The reference numerals of the components shown in FIG. 5 correspond to those in FIG. 1. The spacer 1020 comprises an insulating member 1020*a*, a high-resistance film 1020*b*, which is for the purpose of preventing charging, formed on the surface of the insulating member 1020*a*, and a low-resistance film 2020*c* formed on abutting-contact faces of the spacer that face the inner side (the metal back 1019, etc.) of the face plate 1017 and the surface (the row-direction wiring pattern 1013 or column-direction wiring pattern 1014) of the substrate 1011 and on side portions of the spacer contiguous to the abutting-contact faces. The spacers, which are provided in a number and disposed at intervals necessary for attaining the aforesaid object, are fixed to the inner side of the face plate and to the surface of the substrate 1011 by a bonding material 1041.

The high-resistance film is formed at least on that part of the surface of insulating member 1020*a* that is exposed to the vacuum in the interior of the hermetic envelope and is electrically connected to the inner side (the metal back 1019, etc.) of the face plate 1017 and to the surface (the row-direction wiring pattern 1013 or column-direction wiring pattern 1014) of the substrate 1011 via the low-resistance film 1020*c* on the spacer 1020 and the bonding material 1041. In the mode described here, the spacers 1020 each have the shape of a thin plate and are arranged in parallel with the row-direction wiring patterns 1013 and are electrically connected to the row-direction wiring patterns 1013. Further, numeral 40 denotes an insulating layer.

The spacer 1020 is required to have enough insulation to withstand the high voltage impressed across the row-direction wiring patterns 1013 and column-direction wiring patterns 1014 on the substrate 1011 and the metal back 1019 on the inner surface of the face plate 1017 and enough conductivity to prevent the charging of the surface of the spacer 1020.

Examples of materials for the insulating member 1020*a* of spacer 1020 are quartz glass, glass having a reduced impurity (e.g., Na) content, soda-lime glass or a ceramic member consisting of alumina or the like. It is preferred that the coefficient of thermal expansion of the insulating member 1020*a* be close to that of the members constituting the hermetic envelope and substrate 1011 and that the material used be the same as that of the hermetic envelope.

A current, which is obtained by dividing the accelerating voltage Va applied to the face plate 1017 (metal back 1019, etc.) on the high-potential side by the resistance value Rs of the high-resistance film 1020*b* for preventing charging, flows into the high-resistance film 1020*b* constituting the spacer 1020. Accordingly, the resistance value Rs of the spacer is set within a desirable range from the viewpoints of charging prevention and power consumption. From the viewpoint of preventing charging, a sheet resistance R/□ of no more than $1\times10^{12}$ Ω is preferred. In order to obtain a satisfactory charging preventing effect, a sheet resistance R/o of no more than $1\times10^{11}$ Ω is preferred. Though the lower limit of sheet resistance depends upon the shape of the spacer and voltage impressed across the spacers, a sheet resistance of $1\times10^{5}$ Ω or greater is preferred.

The thickness t of the high-resistance film formed on the insulating member is desired to be within the range 10 nm to 1 μm. Though it differs depending upon the surface energy of the material, the adhesion of the film to the substrate and the substrate temperature, generally a thin film having a thickness of less than 10 nm forms bands, resistance is unstable and reproducibility is poor. In a case where the film thickness t is 1 μm or greater, film stress increases and the danger of film peeling is great. In addition, productivity is poor since forming the film takes a longer period of time. Accordingly, a film thickness of 50~500 nm is desirable. Sheet resistance R/□ is ρ/t, where ρ represents specific resistance. In view of the desired ranges of R/□ and t mentioned above, the specific resistance ρ of the high-resistance film preferably is 0.1 to $1\times10^{8}$ Ωcm. Furthermore, in order to realize more desirable ranges of sheet resistance and film thickness, the specific resistance ρ should be made $1\times10^{2}$ to $1\times10^{6}$ Ωcm.

The temperature of the spacer rises owing to the flow of current through the high-resistance film formed on the spacer, as mentioned above, or as the result of evolution of heat during the operation of the overall display. If the resistance temperature coefficient of the high-resistance film is a large negative value, the resistance value decreases when the temperature rises, as a result of which the current that flows into the spacer increases as well as the temperature. The current continues to rise until the limit of power supply is exceeded. The value of the resistance temperature coefficient at which such current runaway occurs is empirically a negative value, with the absolute value being 1% or greater. That is, it is desired that the resistance temperature coefficient of the high-resistance film be such that the absolute value is less than 1%.

A metal oxide, for example, can be used as the material of the high-resistance film 1020*b* exhibiting the charging preventing characteristic. Among the metal oxides available, oxides of chrome, nickel and copper are preferred. The reason is that these oxides are considered to exhibit a comparatively low secondary electron emission efficiency and are not readily charged even in cases where electrons emitted by the cold cathode elements 1012 strike the spacer 1020. In addition to metal oxides, carbon is another substance exhibiting a low secondary electron emission efficiency. In particular, amorphous carbon has a high resistance and therefore would make it easy to controls the spacer resistance to a desired value.

A nitride of an alloy of aluminum and a transition metal is especially preferable as the material of the high-resistance film 1020*b* exhibiting the charging preventing characteristic because the resistance value can be controlled over a wide range, from that of a good conductor to that of an insulator, by adjusting the composition of the transition metal. Furthermore, such a material exhibits a resistance value which is stable and varies little during the process of fabricating a display device, described later. In addition, the absolute value of the resistance temperature coefficient of such a material is less than 1%, and the material is practical and easy to use. Examples of transition metal elements that can be mentioned are Ti, Cr and Ta, etc.

The alloy nitride film is formed on the insulating member by thin-film forming means such as reactive sputtering, electron beam vapor deposition, ion plating, and ion-assisted vapor deposition, etc., carried out in a nitrogen gas environment. The film of metal oxide can also be fabricated by similar thin-film forming methods, although oxygen would be used instead of nitrogen gas. The metal oxide film can be formed by other metals as well, such as the CVD method or alkoxide application method. In a case where a carbon film, especially amorphous carbon, is fabricated by the vapor deposition method, sputtering method, CVD method or plasma CVD method, etc., it is so arranged that hydrogen is included in the film forming environment, or hydrocarbon gas is used as the film forming gas.

The low-resistance film 1020*c* constituting the spacer 1020 is provided to electrically connect the high-resistance film 1020*b* to the face plate 1017 (the metal back 1019, etc.) on the high-potential side and to the substrate 1011 (the wiring patterns 1013, 1014, etc.) on the low-potential side. The term "intermediate electrode layer" (intermediate layer) will also be used to refer to this film. The intermediate electrode layer (intermediate layer) can have a plurality of functions, set forth below.

1) The intermediate layers electrically connect the high-resistance film 1020*b* to the side of the face plate 1017 and to the side of the substrate 1011.

As described earlier, the high-resistance film 1020*b* is provided for the purpose of preventing charging on the surface of the spacer 1020. In a case where the high-resistance film 1020*b* is connected to the face plate 1017 (the metal back 1019, etc.) and to the substrate 1011 (the wiring patterns 1013, 1014, etc.) directly or via the abutting members 1041, a large contact resistance is produced at the interface of the contacting portions and there is a possibility that electric charge produced on the surface of the spacer will no longer be quickly removable. In order to prevent this, the low-resistance intermediate layer is provided on the abutting faces or side faces of the spacer 1020 that contact the face plate 1017 or abutting member 1041. FIG. 5 shows a case where the abutting faces of the spacer 1020 contact abutting member 1041.

2) The intermediate layer uniformalizes the potential distribution of the high-resistance film 1020*b*.

An electron emitted by the cold cathode 1012 follows an electron path that depends upon the potential distribution produced between face plate 1017 and substrate 1011. In order to arrange it so that the electron path will not be disturbed in the vicinity of the spacer 1020, it is necessary to control the potential distribution of the high-resistance film 1020*b* over the entirety thereof. In a case where the high-resistance film 1020*b* is connected to the face plate 1017 (the metal back 1019, etc.) and to the substrate 1011 (the wiring patterns 1013, 1014, etc.) directly or via the abutting members 1041, the state of the connection becomes non-uniform owing to the contact resistance at the interface of the connected portions and there is the possibility that the potential distribution of the high-resistance film 1020*b* will deviate from the desired value. To prevent this, the low-resistance intermediate layer is provided over the entire length of the spacer edges (the abutting faces or side faces) where the spacer 1020 comes into abutting contact with the side of the face plate 1017 and the side of the substrate 1011, and a prescribed potential is applied to the intermediate layer, thereby making it possible to control the potential of the entire high-resistance film 1020*b*.

3) The intermediate layer controls the paths of the emitted electrons.

An electron emitted by the cold cathode element 1012 follows an electron path that depends upon the potential distribution produced between face plate 1017 and substrate 1011. Because of the behavior of electrons emitted by a cold cathode element in the vicinity of a spacer, the placement of a spacer may result in certain limitations (a change in the positions of the wiring patterns and elements). In order to form an image that is free of distortion or unevenness in such case, it is necessary to control the paths of the emitted electrons so that the electrons will irradiate the desired positions on the face plate 1017. By providing the low-resistance intermediate layer on the side faces of the surfaces that contact the side of the face plate 1017 and the side of the substrate 1011, the potential distribution in the vicinity of the spacer 1020 is provided with a desired characteristic, thereby making it possible to control the paths of the emitted electrons.

The intermediate layer 1020*c* consisting of the low-resistance film should be selected from materials having a resistance value sufficiently low in comparison with the resistance value of the high-resistance film 1020*b*. The selection may be made from the metals such as Ni, Cr, Au, Mo, W, Pt, Ti, Al, Cu, Pd, etc., their alloys, printed conductors consisting of metals or metal oxides such as Pd, Ag, Au, $RuO_2$, Pd—Ag, and glass, etc., transparent conductors such as $In_2O_3$—$SnO_2$ and semiconductor materials such as polysilicon.

The abutting member 1041 is required to possess conductivity in order that the spacer 1020 may be electrically connected to the row-direction wiring pattern 1013 and metal back 1019. More specifically, a preferable material is frit glass to which has been added a conductive adhesive, metal particles or conductive filler.

Electrical connection terminals Dx1~Dxm, Dy1~Dyn and Hv having an air-tight structure are provided to electrically connect the display panel to an electric circuit, which is not shown. The terminals Dx1~Dxm are electrically connected to the row-direction wiring patterns 1013 of the multiple electron beam source, the terminals Dy1~Dyn are electrically connected to the column-direction wiring patterns 1014 of the multiple electron beam source, and the terminal Hv is electrically connected to the metal back 1019 of the face plate.

In order to evacuate the interior of the hermetic envelope, an exhaust pipe and a vacuum pump, not shown, are connected to the hermetic envelope after the hermetic envelope is assembled and the interior of the envelope is exhausted to a vacuum of $1\times10^{-7}$ torr. The exhaust pipe is then sealed. In order to maintain the degree of vacuum within the hermetic envelope, a getter film (not shown) is formed at a prescribed position inside the hermetic envelope immediately before or immediately after the pipe is sealed. The getter film is a film formed by heating a getter material, the main ingredient of which is Ba, for example, by a heater or by high-frequency heating to deposit the material. A vacuum on the order of $1\times10^{-5}$~$1\times10^{-7}$ torr is maintained inside the hermetic envelope by the adsorbing action of the getter film.

When a voltage is applied to each of the cold cathode elements 1012 via the row-direction wiring patterns Dx1~Dxm and column-direction wiring patterns Dy1~Dyn in the image display apparatus having the display panel described above, electrons are emitted from each cold cathode element 1012. Simultaneously applying a high voltage of several hundred to several kilovolts to the metal back 1009 through the external terminal Hv accelerates the emitted electrons and causes these electrons to bombard the face plate 1017. As a result, the phosphors of the various colors constituting the phosphor film 1018 are excited and emit light so as to form an image.

Ordinarily the voltage applied to the surface-conduction emission elements, namely the cold cathode elements, 1012 of this embodiment is 12~16 V, a distance d between the metal back 1019 and cold cathode elements 1012 is 0.1~8 mm and the voltage across the metal back 1019 and the cold cathode element 1012 is 0.1~10 kV.

The basic construction and method of manufacturing the display panel of this embodiment, as well as the general features of the image display apparatus, will now be described.

(2) Method of manufacturing multiple electron beam source

The method of manufacturing the multiple electron beam source used in the display panel of the foregoing embodiment will be described next. If the multiple electron beam source used in the image display apparatus of this invention is an electron source in which cold cathode elements are wired in the form of a simple matrix, there is no limitation upon the material, shape or method of manufacture of the cold cathode elements. Accordingly, it is possible to use cold cathode elements such as surface-conduction electron emission elements or cold cathode elements of the FE or MIM type.

Since there is demand for inexpensive display devices having a large display screen, the surface-conduction electron emission elements are particularly preferred as the cold cathode elements. More specifically, with the FE-type element, the relative positions of the emitter cone and gate electrode and the shape thereof greatly influence the electron emission characteristics. Consequently, a highly precise manufacturing technique is required. This is a disadvantage in terms of enlarging surface area and lowering the cost of manufacture. Further, the inventors have discovered that, among the surface-conduction electron emission elements available, an element in which the electron emission portion or periphery thereof is formed from a film of finely divided particles excels in its electron emission characteristic, and that the element can be manufactured easily. Accordingly, it may be construed that such an element is most preferred for used in a multiple electron beam source in an image display apparatus having a high luminance and a large display screen. Accordingly, in the display panel of the foregoing embodiment, use was made of a surface-conduction electron emission element in which the electron emission portion or periphery thereof was formed from a film of finely divided particles. First, therefore, the basic construction, method of manufacture and characteristics of an ideal surface-conduction electron emission element will be described, and this will be followed by a description of the structure of a multiple electron beam source in which a large number of elements are wired in the form of a matrix.

(Element construction ideal for surface-conduction electron emission elements, and method of manufacturing same)

A planar-type and vertical-type element are the two typical types of construction of surface-conduction electron emission elements available as surface-conduction electron emission elements in which the electron emission portion or periphery thereof is formed from a film of finely divided particles.

(Planar-type surface-conduction electron emission element).

Figure 6A:
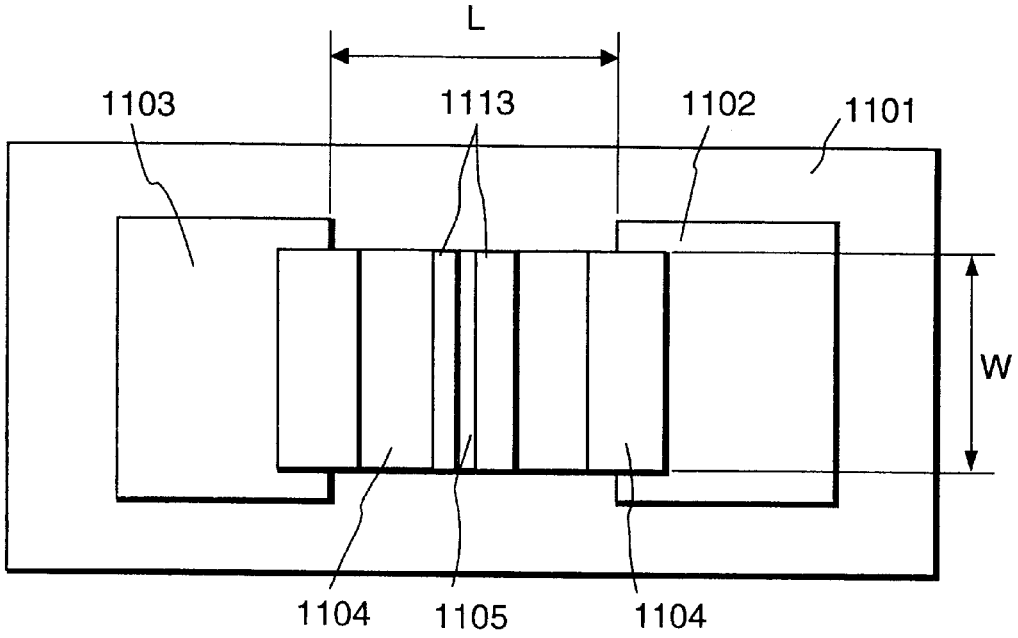
FIG. 6A is a plan view and FIG. 6B a sectional view useful in describing the construction of a planar-type surface-conduction electron emission element.
Figure 6B:
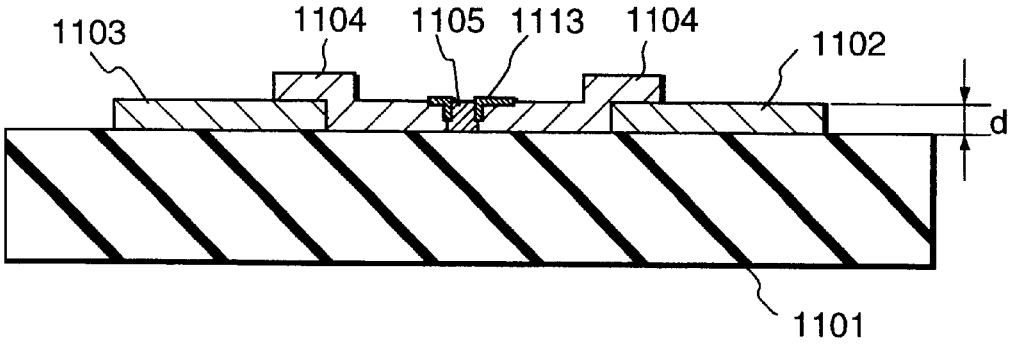

The element construction and manufacture of a planar-type surface-conduction electron emission element will be described first. FIGS. 6A and 6B are plan and sectional views, respectively, for describing the construction of a planar-type surface-conduction electron emission element.

Shown in FIGS. 6A and 6B are a substrate 1101, element electrodes 1102, 1103, an electrically conductive thin film 1104, an electron emission portion 1105 formed by an electrification forming treatment, and a thin film 1113 formed by an electrification activation treatment.

Examples of the substrate 1101 are various glass substrates such as quartz glass and soda-lime glass, various substrates of a ceramic such as alumina, or a substrate obtained by depositing an insulating layer such as $SiO_2$ on the various substrates mentioned above.

The element electrodes 1102, 1103, which are provided so as to oppose each other on the substrate 1101 substantially in parallel with the substrate surface, are formed from a material exhibiting electrical conductivity. Examples of the material that can be mentioned are the metals Ni, Cr, Au, Mo, W, Pt, Ti, Al, Cu, Pd and Ag or alloys of these metals, metal oxides such as $In_2O_3$—$SnO_2$ and semiconductor materials such as polysilicon. If a film manufacturing technique such as vacuum deposition and a patterning technique such as photolithography or etching are used in combination in order to form the electrodes, the electrode can be formed with ease. However, it is permissible to form the electrodes using another method (such as a printing technique).

The shapes of the element electrodes 1102, 1103 are decided in conformity with the application and purpose of the electron emission element. In general, the spacing L between the electrodes may be a suitable value selected from a range of several hundred Angstroms to several hundred microns. Preferably, the range is on the order of several microns to tens of microns in order for the device to be used in a display apparatus. With regard to the thickness d of the element electrodes, a suitable numerical value is selected from a range of several hundred Angstroms to several microns.

A film of finely divided particles is used at the portion of the electrically conductive thin film 1104. The film of finely divided particles mentioned here signifies a film (inclusive of island-shaped aggregates) containing a large number of finely divided particles as structural elements. If a film of finely divided particles is examined microscopically, usually the structure observed is one in which individual fine particles are arranged in spaced-apart relation, one in which the particles are adjacent to one another and one in which the particles overlap one another.

The particle diameter of the finely divided particles used in the film of finely divided particles falls within a range of from several Angstroms to several thousand Angstroms, with the particularly preferred range being 10 to 200 Å. The film thickness of the film of finely divided particles is suitably selected upon taking into consideration the following conditions: conditions necessary for achieving a good electrical connection between the element electrodes 1102 and 1103, conditions necessary for carrying out electrification forming, described later, and conditions necessary for obtaining a suitable value, described later, for the electrical resistance of the film of finely divided particles per se. More specifically, the film thickness is selected in the range of from several Angstroms to several thousand Angstroms, preferably 10 to 500 Å.

Examples of the material used to form the film of finely divided particles are the metals Pd, Pt, Ru, Ag, Au, Ti, In, Cu, Cr, Fe, Zn, Sn, Ta, W and Pb, etc., the oxides PdO, $SnO_2$, $In_2O_3$, PbO and $Sb_2O_3$, etc., the borides $HfB_2$, $ZrM_2$, $LaB_6$, $CeB_6$, $YB_4$ and $GdB_4$, the carbides TiC, ZrC, HfC, TaC, SiC and WC, etc., the nitrides TiN, ZrN and HfN, etc., the semiconductors Si, Ge, etc., and carbon. The material may be selected appropriately from these.

As mentioned above, the electrically conductive thin film 1104 is formed from a film of finely divided particles. The sheet resistance is set so as to fall within the range of from $10^3$ to $10^7$ Ω/□.

Since it is preferred that the electrically conductive thin film 1104 come into good electrical contact with the element electrodes 1102, 1103 when connected thereto, the adopted structure is such that the film and the element electrodes partially overlap each other. As for the methods of achieving this overlap, one method is to build up the device from the bottom in the order of the substrate, element electrodes and electrically conductive film, as shown in the example of FIGS. 6A and 6B. Depending upon the case, the device may be built up from the bottom in the order of the substrate, electrically conductive film and element electrodes.

The electron emission portion 1105 is a crack-shaped portion formed in part of the electrically conductive thin film 1104 and, electrically speaking, has a resistance higher than that of the surrounding. conductive thin film. The crack is formed by subjecting the electrically conductive thin film 1104 to an electrification forming treatment, described later. There are cases in which finely divided particles having a particle diameter of several Angstroms to several hundred Angstroms are placed inside the crack. It should be noted that since it is difficult to illustrate, finely and accurately, the actual position and shape of the electron emission portion, only a schematic illustration is given in FIGS. 6A and 6B.

The thin film 1113 comprises carbon or a carbon compound and covers the electron emission portion 1105 and its vicinity. The thin film 1113 is formed by carrying out an electrification activation treatment, described later, after the electrification forming treatment.

The thin film 1113 is one or a mixture of single-crystal graphite, polycrystalline graphite or amorphous carbon. The film thickness preferably is less than 500 Å, especially less than 300 Å.

It should be noted that since it is difficult to precisely illustrate the actual position and shape of the thin film 1113, only a schematic illustration is given in FIGS. 6A, 6B. Further, in the plan view of FIG. 6A, the element is shown with part of the thin film 1113 removed.

The desired basic construction of the element has been described. The element set forth below was used in this embodiment.

Soda-lime glass was used as the substrate 1101, and a thin film of Ni was used as the element electrodes 1102, 1103. The thickness d of the element electrodes was 1000 Å, and the electrode spacing L was 2 μm. Pd or PdO was used as the main ingredient of the film of finely divided particles, the thickness of the film of finely divided particles was about 100 Å, and the width W was 100 μm.

The method of manufacturing the preferred planar-type of surface-conduction electron emission element will now be described.

FIGS. 7A~7E are sectional views for describing the process steps for manufacturing the surface-conduction electron emission element. Portions similar to those in FIG. 6A, 6B are designated by like reference numerals.

Figure 7A:
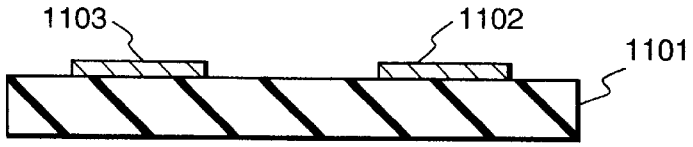
FIGS. 7A~7E are sectional views useful in describing a process for manufacturing a surface-conduction electron emission element.

1) First, the element electrodes 1102, 1103 are formed on the substrate 1101, as shown in FIG. 7A.

With regard to formation, the substrate 1101 is cleansed sufficiently in advance using a detergent, pure water or an organic solvent, after which the element electrode material is deposited. (An example of the deposition method used is a vacuum film-forming technique such as vapor deposition or sputtering.) Thereafter, the deposited electrode material is patterned using photolithography to form the pair of electrodes 1102, 1103 shown in FIG. 7A.

Figure 7B:
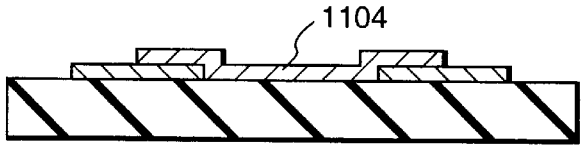

2) Next, the electrically conductive thin film 1104 is formed, as shown in FIG. 7B.

With regard to formation, the substrate of FIG. 7A is coated with an organic metal solution, the latter is allowed to dry, and heating and calcination treatments are applied to form a film of finely divided particles. Patterning is then carried out by photolithographic etching to obtain a prescribed shape. The organic metal solution is a solution of an organic metal compound in which the main element is the material of the finely divided particles used in the electrically conductive film. (Specifically, Pd was used as the main element in this embodiment. Further, the dipping method was employed as the method of application in this embodiment. However, other methods which may be used are the spinner method and spray method.)

Further, besides the method of applying the organic metal solution used in this embodiment as the method of forming the electrically conductive thin film made of the film of finely divided particles, there are cases in which use is made of vacuum deposition and sputtering or chemical vapor deposition.

Figure 7C:
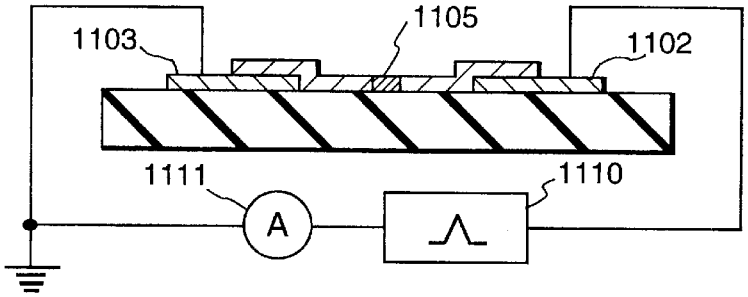

3) Next, as shown in FIG. 7C, a suitable voltage is applied across the element electrodes 1102 and 1103 from a forming power supply 1110, whereby an electrification forming treatment is carried out to form the electron emission portion 1105.

The electrification forming treatment includes passing a current through the electrically conductive thin film 1104 of FIG. 7B, which is made from the film of finely divided particles, to locally destroy, deform or change the property of this portion, thereby obtaining a structure ideal for performing electron emission. At the portion of the electrically conductive film, made of the film of finely divided particles, changed to a structure ideal for electron emission (i.e., the electron emission portion 1105), a crack suitable for a thin film is formed. When a comparison is made with the situation prior to formation of the electron emission portion 1105, it is seen that the electrical resistance measured between the element electrodes 1102 and 1103 after formation has increased to a major degree.

Figure 8:
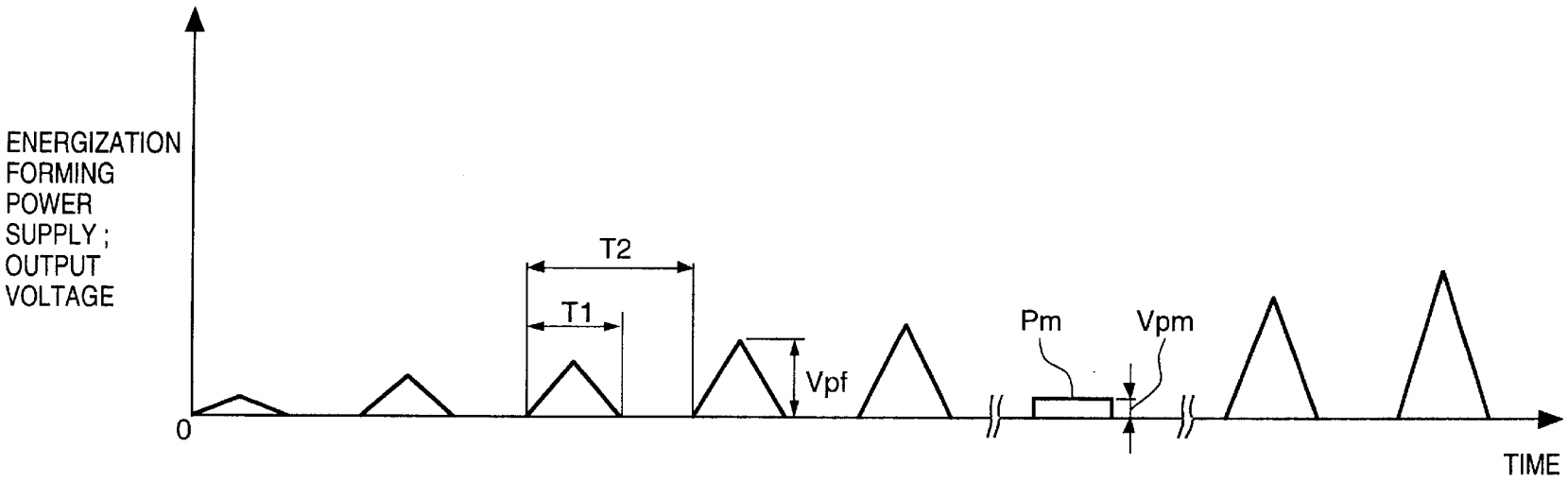
FIG. 8 is a diagram showing an example of an voltage waveform applied by a power supply for forming process.

In order to give a more detailed description of the electrification method, an example of a suitable voltage waveform supplied from the forming power supply 1110 is shown in FIG. 8. In a case where the electrically conductive film made of the film of finely divided particles is subjected to forming, a pulsed voltage is preferred. In the case of this embodiment, triangular pulses having a pulse width T1 were applied consecutively at a pulse interval T2, as illustrated in the Figure. At this time, the peak value Vpf of the triangular pulses was gradually increased. A monitoring pulse Pm for monitoring the formation of the electron emission portion 1105 was inserted between the triangular pulses at a suitable spacing and the current which flows at such time was measured by an ammeter 1111.

In this embodiment, under a vacuum of, say, $1\times10^{-5}$ torr, the pulse width T1 and pulse interval T2 were made 1 ms and 10 ms, respectively, and the peak voltage Vpf was elevated at increments of 0.1 V every pulse. The monitoring pulse Pm was inserted at a rate of once per five of the triangular pulses. The voltage Vpm of the monitoring pulses was set to 0.1 V so that the forming treatment would not be adversely affected. Electrification applied for the forming treatment was terminated at the stage where the resistance between the terminal electrodes 1102, 1103 became $1\times10^{6}$ Ω, namely at the stage where the current measured by the anmeter 1111 at application of the monitoring pulse fell below $1\times10^{7}$ Å.

The method described above is preferred in relation to the surface-conduction electron emission element of this embodiment. In a case where the material or film thickness of the film consisting of the finely divided particles or the design of the surface-conduction electron emission element such as the element-electrode spacing L is changed, it is desired that the conditions of electrification be altered accordingly.

Figure 7D:
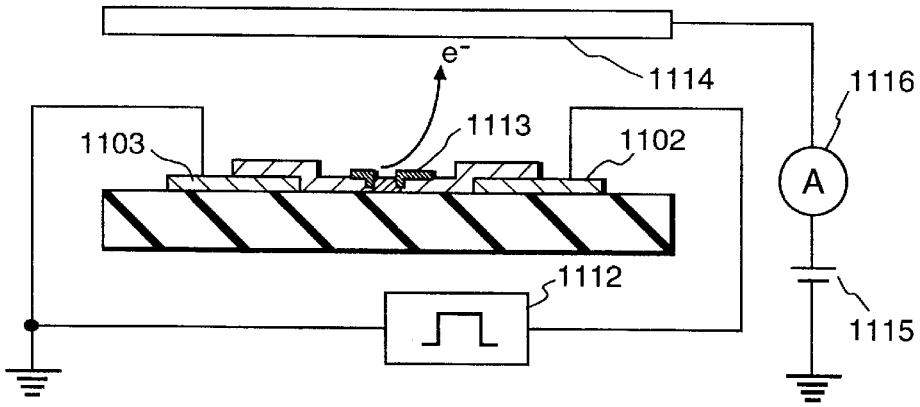

4) Next, as shown in FIG. 7D, a suitable voltage from an activating power supply 1112 was impressed across the element electrodes 1102, 1103 to apply an electrification activation treatment, thereby improving the electron emission characteristic.

This electrification activation treatment involves subjecting the electron emission portion 1105 of FIG. 7C, which has been formed by the above-described electrification forming treatment, to electrification under suitable conditions and depositing carbon or a carbon compound in the vicinity of this portion. (In the Figure, the deposit consisting of carbon or carbon compound is illustrated schematically as a member 1113.) By carrying out this electrification activation treatment, the emission current typically can be increased by more than 100 times, at the same applied voltage, in comparison with the current before application of the treatment.

More specifically, by periodically applying voltage pulses in a vacuum ranging from $1\times10^{-4}$ to $1\times10^{-5}$ torr, carbon or a carbon compound in which an organic compound present in the vacuum serves as the source is deposited. The deposit 1113 is one or a mixture of single-crystal graphite, polycrystalline graphite or amorphous carbon. The film thickness is less than 500 Å, preferably less than 300 Å.

Figure 9A:
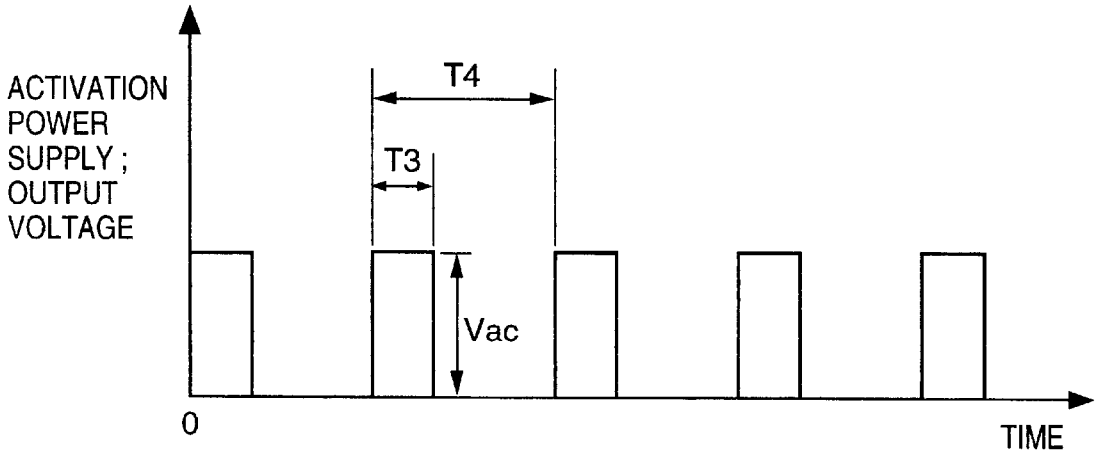
FIGS. 9A and 9B are diagrams for describing an example of an activation treatment.

In order to give a more detailed description of the electrification method, an example of a suitable waveform supplied by the activation power supply 1112 is illustrated in FIG. 9A. In this embodiment, the electrification activation treatment was conducted by periodically applying rectangular waves of a fixed voltage. More specifically, the voltage Vac of the rectangular waves was made 14 V, the pulse width T3 was made 1 ms, and the pulse interval T4 was made 10 ms. The electrification conditions for activation mentioned above are desirable conditions in relation to the surface-conduction electron emission element of this embodiment. In a case where the design of the surface-conduction electron emission element is changed, it is desired that the conditions be changed accordingly.

Figure 9B:
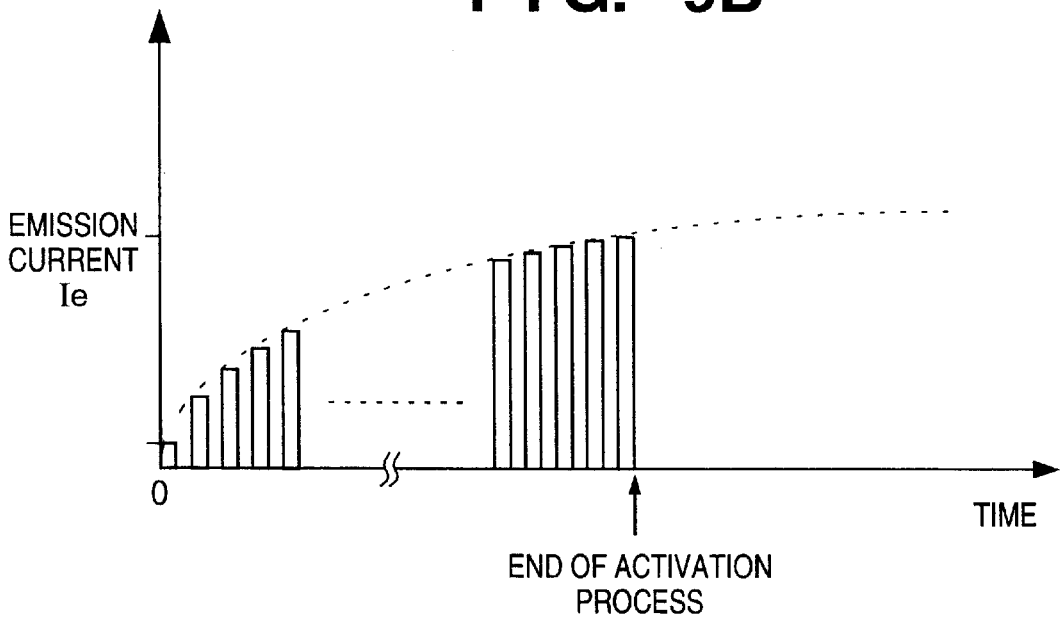

Numeral 1114 in FIG. 7D denotes an anode electrode for capturing the emission current Ie obtained from the surface-conduction electron emission element. The anode electrode is connected to a DC high-voltage power supply 1115 and to an ammeter 1116. (In a case where the activation treatment is carried out after the substrate 1101 is installed in the display panel, the phosphor surface of the display panel is used as the anode electrode 1114.) During the time that the voltage is being supplied from the activation power supply 1112, the emission current Ie is measured by the ammeter 1116 to monitor the progress of the electrification activation treatment, and the operation of the activation power supply 1112 is controlled. FIG. 9B illustrates an example of the emission current Ie measured by the ammeter 1116. When the pulsed voltage starts being supplied by the activation power supply 1112, the emission current Ie increases with the passage of time but eventually saturates and then almost stops increasing. At the moment the emission current Ie thus substantially saturates, the application of voltage from the activation power supply 1112 is halted and the activation treatment by electrification is terminated.

It should be noted that the above-mentioned electrification conditions are preferred conditions in relation to the surface-conduction electron emission element of this embodiment. In a case where the design of the surface-conduction electron emission element is changed, it is desired that the conditions be changed accordingly.

Figure 7E:
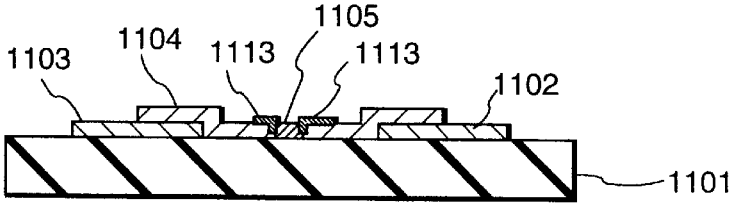

Thus, the planar-type surface-conduction electron emission element shown in FIG. 7E is manufactured as set forth above.

(Vertical-type surface-conduction electron emission element).

Next, one more typical construction of a surface-conduction electron emission element in which the electron emission portion or its periphery is formed from a film of finely divided particles, namely the construction of a vertical-type surface-conduction electron emission element, will be described.

Figure 10:
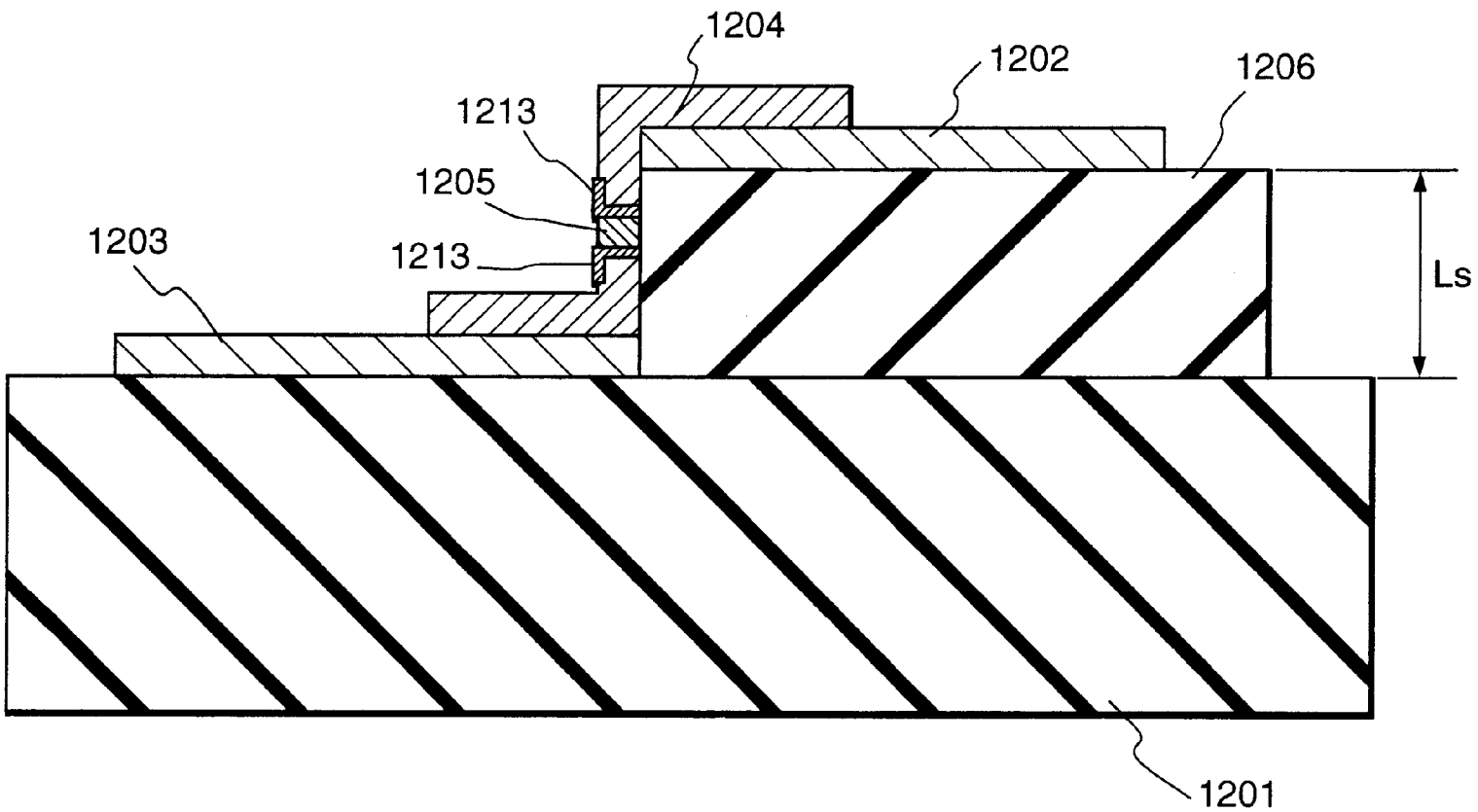
FIG. 10 is a schematic sectional view useful in describing the basic construction of a vertical-type surface-conduction electron emission element.

FIG. 10 is a schematic sectional view for describing the basic construction of the vertical-type element. Numeral 1201 denotes a substrate, 1202 and 1203 element electrodes, 1206 a step forming member, 1204 an electrically conductive thin film using a film of finely divided particles, 1205 an electron emission portion formed by an electrification forming treatment, and 1213 a thin film formed by an electrification activation treatment.

The vertical-type element differs from the planar-type element in that one element electrode (1202) is provided on the step forming member 1206, and in that the electrically conductive thin film 1204 covers the side of the step forming member 1206. Accordingly, the element-electrode spacing L in the planar-type surface-conduction electron emission element shown in FIG. 6A is set as the height Ls of the step forming member 1206 in the vertical-type element. The substrate 1201, the element electrodes 1202, 1203 and the electrically conductive thin film 1204 using the film of finely divided particles can consist of the same materials mentioned in the description of planar-type element. An electrically insulating material such as $SiO_2$ is used as the step forming member 1206.

A method of manufacturing the vertical-type surface-conduction electron emission element will now be described. FIGS. 11A~11F are sectional views for describing the manufacturing steps. The reference characters of the various members are the same as those in FIG. 10.

Figure 11A:
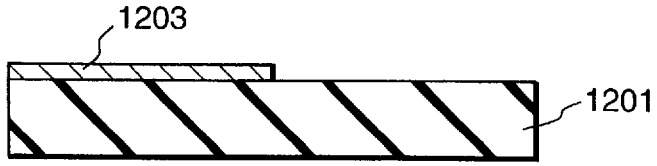
FIGS. 11A~11F are sectional views useful in describing a process for manufacturing a vertical-type surface-conduction electron emission element.

1) First, the element electrode 1203 is formed on the substrate 1201, as shown in FIG. 11A.

Figure 11B:
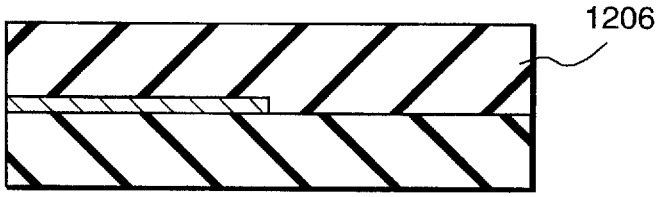

2) Next, an insulating layer 1206 for forming the step forming member is built up, as shown in FIG. 11B. It will suffice if this insulating layer 1206 is formed by building up $SiO_2$ using the sputtering method. However, other film forming methods may be used, such as vacuum deposition or printing, by way of example.

Figure 11C:
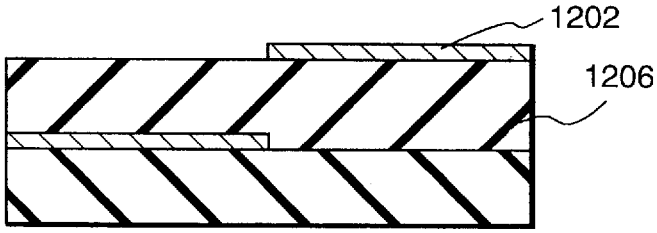

3) Next, the element electrode 1202 is formed on the insulating layer 1206, as shown in FIG. 11C.

Figure 11D:
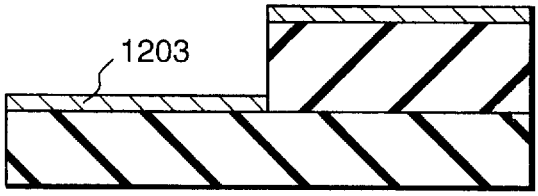

4) Next, part of the insulating layer 1206 in FIG. 11C is removed as by an etching process, thereby exposing the element electrode 1203, as shown in FIG. 11D.

Figure 11E:
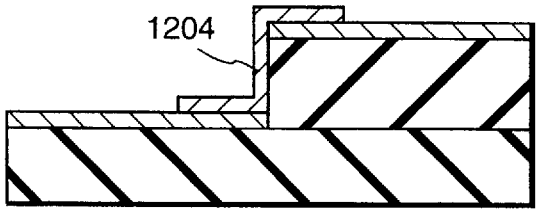

5) Next, the electrically conductive thin film 1204 using the film of finely divided particles is formed, as shown in FIG. 11E. In order to form the electrically conductive thin film, it will suffice to use a film forming technique such as painting in the same manner as in the case of the planar-type element.

6) Next, an electrification forming treatment is carried out in the same manner as in the case of the planar-type element, thereby forming the electron emission portion 1205 on the conductive thin film 1204 of FIG. 11E. (It will suffice to carry out a treatment similar to the planar-type electrification forming treatment described using FIG. 7C.)

7) Next, as in the case of the planar-type element, the electrification activation treatment is performed to deposit carbon or a carbon compound 1213 in the vicinity of the electron emission portion. (It will suffice to carry out a treatment similar to the planar-type electrification activation treatment described using FIG. 7D.)

Figure 11F:
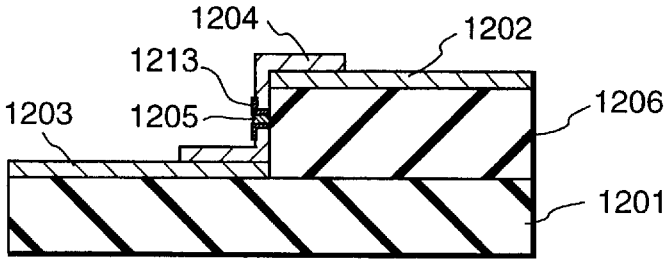

Thus, the vertical-type surface-conduction electron emission element shown in FIG. 11F is manufactured as set forth above.

(Characteristics of surface-conduction electron emission element used in display apparatus).

The element construction and method of manufacturing the planar- and vertical-type surface-conduction electron emission elements have been described above. The characteristics of these elements used in a display apparatus will now be described.

Figure 12:
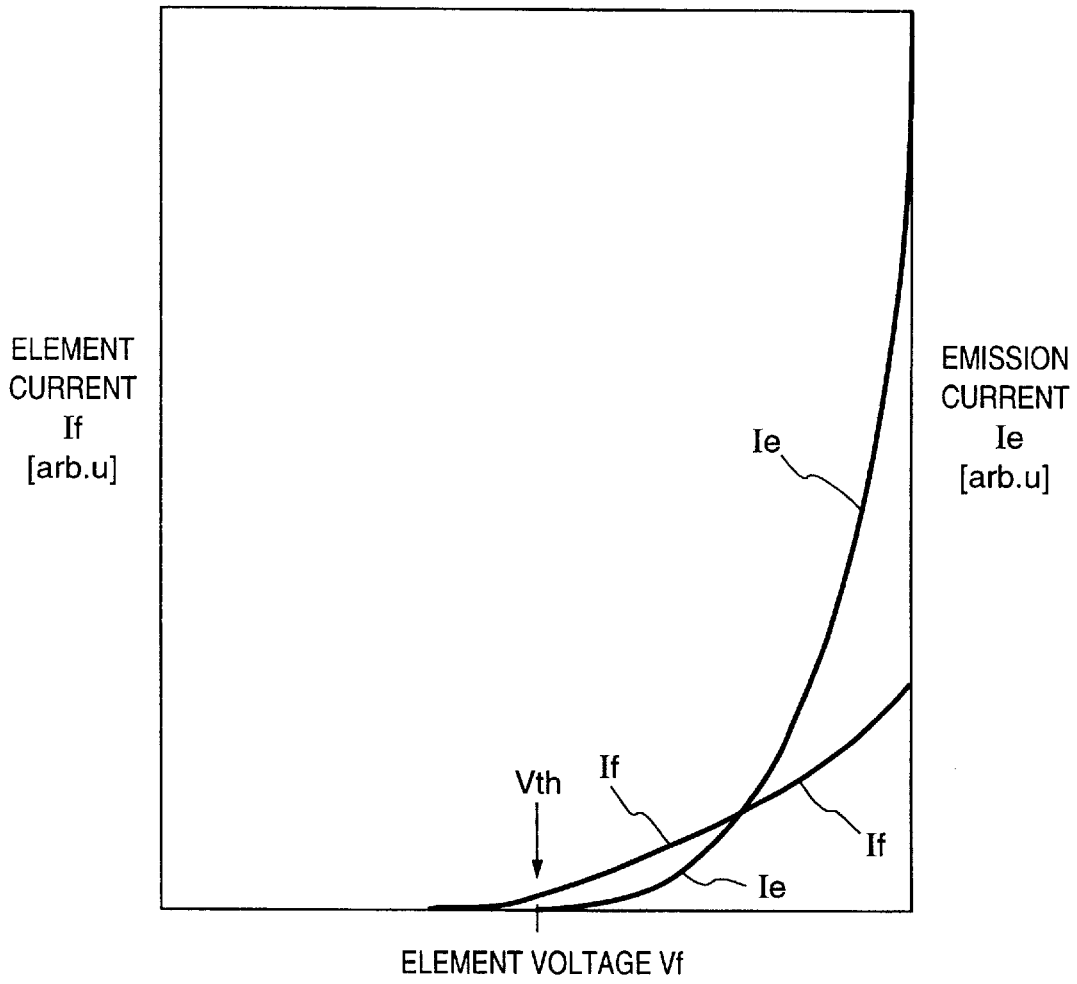
FIG. 12 is a graph showing a typical example of an (emission current Ie) vs. (applied element voltage Vf) characteristic and of an (element current If) vs. (applied element voltage Vf) characteristic of the elements used in a display apparatus.

FIG. 12 illustrates a typical example of an (emission current Ie) vs. (applied element voltage Vf) characteristic and of an (element current If) vs. (applied element voltage Vf) characteristic of the elements used in a display apparatus. It should be noted that the emission current Ie is so much smaller than the element current If that it is difficult to use the same scale to illustrate it. Moreover, these characteristics are changed by changing the design parameters such as the size and shape of the elements. Accordingly, the two curves in the graph are each illustrated using arbitrary units.

The elements used in this display apparatus have the following three features in relation to the emission current Ie:

First, when a voltage greater than a certain voltage (referred to as a threshold voltage Vth) is applied to the element, the emission current Ie suddenly increases. When the applied voltage is less than the threshold voltage Vth, on the other hand, almost no emission current Ie is detected. In other words, the element is a non-linear element having the clearly defined threshold voltage Vth with respect to the emission current Ie.

Second, since the emission current Ie varies in dependence upon the voltage Vf applied to the element, the magnitude of the emission current Ie can be controlled by the voltage Vf.

Third, since the response speed of the current Ie emitted from the element is high in response to a change in the voltage Vf applied to the element, the amount of charge of the electron beam emitted from the element can be controlled by the length of time over which the voltage Vf is applied.

Because they possess the foregoing characteristics, surface-conduction electron emission elements are ideal for use in a display apparatus. For example, in a display apparatus in which a number of elements are provided to correspond to pixels of a displayed image, the display screen can be scanned sequentially to present a display if the first characteristic mentioned above is utilized. More specifically, a voltage greater than the threshold voltage Vth is suitably applied to driven elements in conformity with a desired light-emission luminance, and a voltage less than the threshold voltage Vth is applied to elements that are in an unselected state. By sequentially switching over elements driven, the display screen can be scanned sequentially to present a display.

Further, by utilizing the second characteristic or third characteristic, the luminance of the emitted light can be controlled. This makes it possible to present a grayscale display.

(Structure of multiple electron beam source having number of elements wired in form of simple matrix)

Described next will be the structure of a multiple electron beam source obtained by arraying the aforesaid surface-conduction electron emission elements on a substrate and wiring the elements in the form of a simple matrix.

FIG. 2 is a plan view of a multiple electron beam source used in the display panel of FIG. 1. Here surface-conduction electron emission elements similar to the type shown in FIG. 6A are arrayed on the substrate and these elements are wired in the form of a simple matrix by the row-direction wiring electrodes 1013 and column-direction wiring electrodes 1014. An insulating layer (not shown) is formed between the electrodes at the portions where the row-direction wiring electrodes 1013 and column-direction wiring electrodes 1014 intersect, thereby maintaining electrical insulation between the electrodes.

FIG. 3 is a sectional view taken along line 3—3 of FIG. 2.

It should be noted that the multiple electron source having this structure is manufactured by forming the row-direction wiring electrodes 1013, column-direction wiring electrodes 1014, inter-electrode insulating layer (not shown) and the element electrodes and electrically conductive thin film of the surface-conduction electron emission elements on the substrate in advance, and then applying the electrification forming treatment and electrification activation treatment by supplying current to each element via the row-direction wiring electrodes 1013 and column-direction wiring electrodes 1014.

(3) Construction of drive circuit (and method of driving same)

Figure 13:
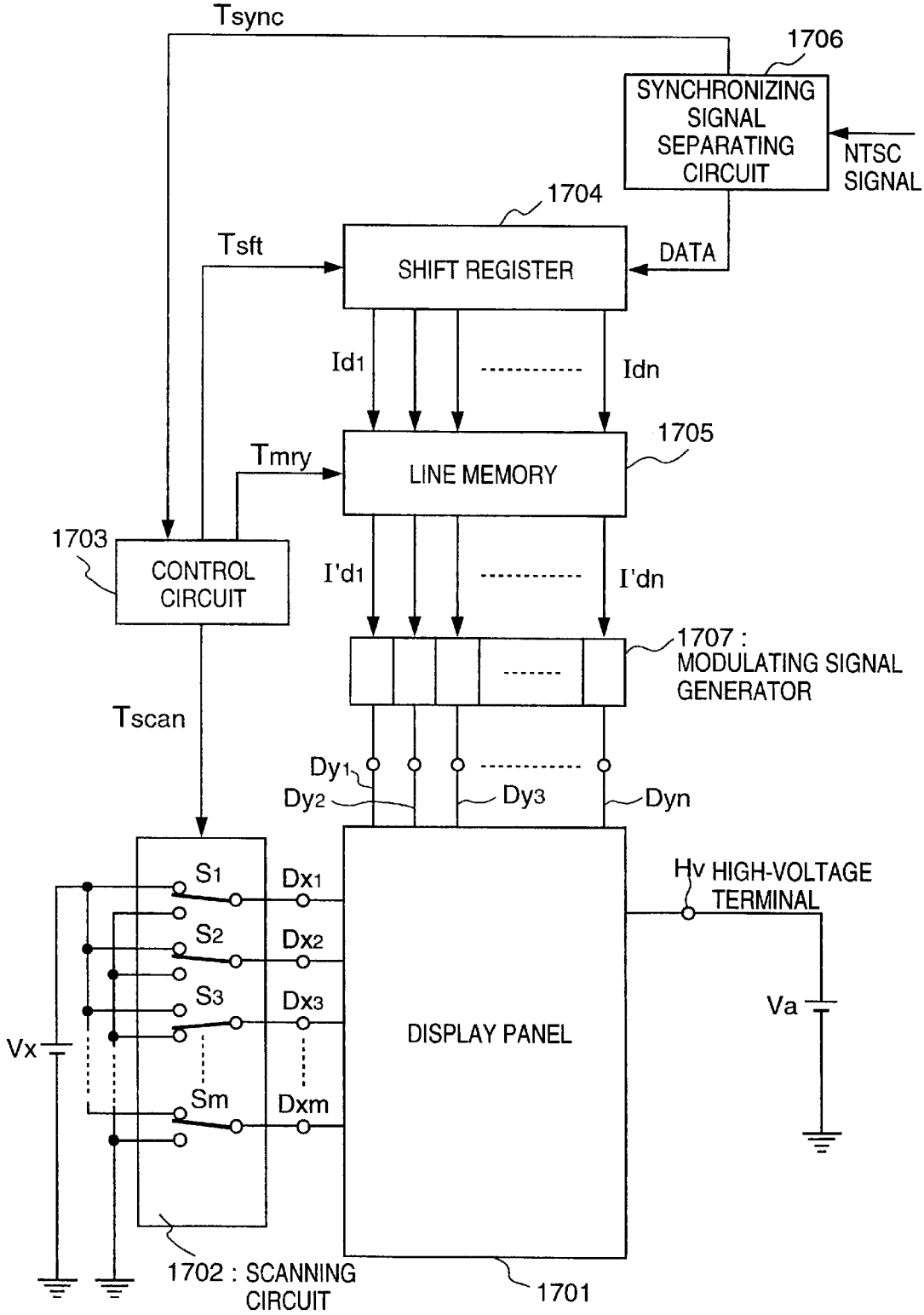
FIG. 13 is a block diagram showing the construction of a drive circuit for presenting a television display based upon an NTSC television signal.

FIG. 13 is a block diagram showing the construction of a drive circuit for presenting a television display based upon an NTSC television signal. A display panel 1701 in FIG. 13 corresponds to the above-described display panel and is manufactured and operates in the manner set forth above. A scanning circuit 1702 scans display lines and a control circuit 1703 generates signals, etc., input to the scanning circuit 1702. A shift register 1704 shifts data line by line, and a line memory 1705 inputs one line of data from the shift register 1704 to a modulating signal generator 1707. A synchronizing signal separating circuit 1706 separates a synchronizing signal from the NTSC signal.

The functions of each these components in the apparatus of FIG. 13 will now be described in detail.

The display panel 1701 is connected to external electrical circuitry via the terminals Dx1~Dxm, terminals Dx1~Dyn and high-voltage terminal Hv. Scanning signals for successively driving, one row (n elements) at a time, the multiple electron beam sources provided within the display panel 1701, namely the cold cathode elements matrix-wired in the form of an m-row, n-column matrix, are applied to the terminals Dx1~Dxm. Modulating signals for controlling the output electron beams of the respective n-number of elements of a row selected by the scanning signals are applied to the terminals Dx1~Dyn. A DC voltage of, e.g., 5 kV, is supplied from a DC voltage source Va to the high-voltage terminal Hv. This is an accelerating voltage for providing the electron beams, which are output by the multiple electron beam source, with enough energy to excite the phosphors.

The scanning circuit 1702 will be described next. The scanning circuit 1702 is internally provided with m-number of switching elements (indicated schematically at S1 through Sm). Each switching element selects either the output voltage of a DC voltage source Vx or 0 V (the ground level) and electrically connects the selected voltage to a corresponding one of the terminals Dx1 through Dxm of the display panel 1701. In actuality it is possible to readily realize the switching elements by combining switching elements such as FETs, by way of example. It should be noted that the output voltage of the DC voltage source Vx has been set, based upon the characteristic (exemplified in FIG. 12) of the cold cathode element, in such a manner that a drive voltage applied to an element not being scanned will fall below the electron-emission threshold voltage Vth.

On the basis of an image signal that enters from the outside, the control circuit 1703 acts to coordinate the operation of each component so as to present an appropriate display. On the basis of a synchronizing signal Tsync sent from the synchronizing signal separating circuit 1706, described next, the control circuit 1703 generates control signals Tscan, Tsft and Tmry applied to the scanning circuit 1702, shift register 1704 and line memory 1705. The synchronizing signal separating circuit 1706, which separates a synchronizing signal component and a luminance signal component from the NTSC television signal externally applied thereto, can be constructed easily if use is made of a frequency separating (filtering) circuit, as is well known. The synchronizing signal that has been separated by the synchronizing signal separating circuit 1706 comprises a vertical synchronizing signal and a horizontal synchronizing signal, as is well known, but is illustrated as Tsync in FIG. 13 in order to facilitate the description. The luminance signal component of the image separated from the above-mentioned television signal is represented by "DATA" for the sake of convenience and enters the shift register 1704.

The shift register 1704 is for converting the DATA signal, which enters serially in a time series, from the serial to a parallel signal every line of the image. The shift register 1704 operates based upon the control signal Tsft sent from the control circuit 1703. More specifically, the control signal Tsft can also be referred to as a shift clock of the shift register 204. The serial/parallel-converted data of one line of the image data (which corresponds to the drive data of n-number of electron emission elements) is output from the shift register 1704 as n-number of signals Id1~Idn.

The line memory 1705 stores one line of the image data for a requisite period of time only. The line memory 1705 stores the contents of Id1~Idn in accordance with the control signal Tmry sent from the control circuit 1703. The contents thus stored are output as I'd1~I'dn, which enter the modulating signal generator 1707.

The modulating signal generator 1707 is a signal source for driving and modulating the electron emission elements 1015 appropriately in dependence upon the image data I'd1~I'dn, and the outputs thereof are applied to the electron emission elements in the display panel 1701 through the terminals Dx1~Dyn.

As described with reference to FIG. 12, the surface-conduction emission elements relating to this embodiment have the following basic characteristics with respect to the emission current Ie: The electron emission elements have a definite threshold value Vth (8 V with the surface-conduction emission elements of this embodiment, described later), and an electron emission occurs only when a voltage greater than Vth has been applied. Further, the emission current Ie also changes in conformity with a change in voltage, as shown in FIG. 12, with respect to the voltage above the electron-emission threshold value. Accordingly, in a case where a pulsed voltage is applied to these elements, no electron emission is produced if a voltage less than the electron-emission threshold voltage is applied. However, an electron beam is output in a case where a pulsed voltage above the electron-emission threshold value Vth is applied. It is possible to control the intensity of the output electron beam by varying the peak value Vm of the pulses at this time, and it is possible to control the total amount of electric charge of the output electron beam by varying the width Pw of the pulses.

Accordingly, voltage modulation or pulse-width modulation can be employed as the method of modulating the electron emission elements in dependence upon the input signal. When voltage modulation is implemented, the modulating signal circuit employed as the modulating signal generator 1707 would generate voltage pulses of a fixed length and would modulate the peak value of the pulses in conformity with the input data. When pulse-width modulation is implemented, the pulse-width modulating circuit employed as the modulating signal generator 1707 would generate voltage pulses of a fixed peak value and would modulate the width of the voltage pulses in conformity with the input data.

The shift register 1704 and line memory 1705 employed may be for digital or analog signals. That is, it will suffice if the serial/parallel conversion and storage of image signals are carried out at a prescribed speed.

In a case where digital-type circuits are used, it is required that the output signal DATA of the synchronizing signal separating circuit 1706 be converted to a digital signal. To achieve this, it will suffice to provide an A/D converter at the output of the synchronizing signal separating circuit 1706. In relation to this, the circuitry used in the modulating signal generator will differ slightly depending upon whether the output signal of the line memory 115 is digital or analog. More specifically, in case of voltage modulation using a digital signal, a D/A converting circuit, for example, is used as the modulating signal generator 1707 and an amplifying circuit or the like is added on as necessary.

In case of pulse-width modulation, the circuit used for the modulating signal generator 1707 is a combination of a high-speed oscillator, a counter for counting the number of waves output by the oscillator and a comparator for comparing the output value of the counter with the output of the above-mentioned memory. If necessary, an amplifier is added on in order to voltage-amplify the pulse-width modulated signal output by the comparator to a voltage that drives the electron emission elements.

In case of voltage modulation using an analog signal, an amplifying circuit using an operational amplifier or the like can be employed as the modulating signal generator 1707, and a shift level circuit or the like can be added on as necessary. In case of pulse-width modulation, a voltage-controlled oscillator (VCO) circuit, for example, can be used and, if necessary, an amplifier is added on for performing voltage amplification up to the driving voltage of the electron emission elements.

In an image display apparatus to which this embodiment having the above-described construction can be applied, an electron emission is produced by applying voltage to each of the electron emission elements via the external terminals Dx1~Dxm, Dx1~Dyn of the envelope. A high voltage is applied to the metal back 1019 or transparent electrode (not shown) via the high-voltage terminal Hv, thereby accelerating the electron beam. The accelerated electrons bombard the phosphor film 1018, whereby a light emission is produced to form an image.

The construction of the image display apparatus described above is an example of an image forming apparatus to which the present invention is applicable and can be modified in various ways based upon the idea of the present invention. Though an NTSC signal has been mentioned as an example of an input signal, this does not impose a limitation upon the input signals. Examples of signals that can be used are PAL and SECAM signals. In addition, a TV signal comprising a greater number of scanning lines (e.g., a high-definition TV signal such as one based upon the MUSE system) can be used.

(Spacers)

As mentioned earlier, the low-resistance film (intermediate layer) 1020*c* is provided on the edges of the high-resistance film 1020*b* (the abutting-contact faces or side faces of the spacer 1020) that abut against the face plate 1017 and substrate 1011. The low-resistance films 1020*c* on the side of the face plate 1017 and on the side of the substrate 1011 are electrically connected to the high-resistance film 1020*b*. If the shape of the low-resistance film (intermediate layer) 1020*c* should happen to include a projecting portion, a sudden change in the electric field would occur in the vicinity thereof and the projection would be the cause of an electric discharge.

FIGS. 14A through 14D illustrate examples of the low-resistance film 1020*c* wherein the film shape includes a projection. Portions A in FIG. 14A show an example of the low-resistance film (intermediate layer) 1020*c* on the side surface of the high-resistance film 1020*b* where the latter contacts the side of the face plate 1017 and the side of the substrate 1011. In this example the low-resistance film (intermediate layer) 1020*c* defines an angle of 90°. The electric field at the portion having this right angle intensifies. At portions B in FIG. 14C, the long side face and short side face of the spacer 1020 define an angle of 90° and, as a consequence, the electric field at the edge where these faces intersect is intensified.

Measures for solving this problem will now be described.

In order to arrange it so that a sudden change in electric field will not occur, the low-resistance film (intermediate layer) 1020*c* is formed solely of a straight lines and curves having a large curvature. More specifically, it is arranged so that the edge of the low-resistance film 1020*c* that is exposed to the interior of the hermetic envelope will not include a shape such as a projection, acute angle or curve having a small radius of curvature.

In FIGS. 15A and 15B, let G represent the distance between both of the low-resistance films 1020*c* (the hatched portions) of the spacer 1020 (namely the low-resistance film on the side of face plate 1017 and the low-resistance film on the side of substrate 1011), let Va represent a voltage applied across the low-resistance films 1020*c*, and let r represent the radius of curvature of the low-resistance films 1020*c* at the end portions thereof. Under these conditions, a maximum electric field strength Emax produced at the end portions of the low-resistance film 1020*c* will be approximately as follows:

$$Emax=\beta(Va/G)$$

$$\beta=[2(G/r)/\ln\ (4G/r)]$$

Here Va/G is the average electric field strength produced between the two low-resistance films 1020*c*, and the coefficient β represents the rate indicating how much the electric field strength intensifies at the end portions of the low-resistance films 1020*c*. The equations cited above correspond to a case where a projection has a shape with almost rotational symmetry along the average direction of the electric field. In the present invention, the arrangement is such that the spacer has the low-resistance films 1020*c* on both its front and back surface with respect to the thickness direction of the spacer. This arrangement is considered to correspond to a shape intermediate a shape having rotational symmetry and a shape having symmetry with respect to a plane (e.g., a cylindrical shape). In regard to a shape having symmetry with respect to a plane, the coefficient β can be estimated to be approximately $$\beta=(1/4)\cdot\sqrt{G/r}$$

In other words, when β is 100 in case of a shape having rotational symmetry, β becomes approximately ten in case of a shape having symmetry with respect to a plane. Accordingly, when a rough estimate is made in the case of the present invention, it is presumed that β will be 20 to a factor of 50.

Though it is estimated theoretically that an electron emission due to a strong electric field formed in the vicinity of a projection or corner will be produced by an electric field on the order of $1\times10^9$ V/m, it has been shown experimentally that the probability of a field emission rises when $1\times10^7$ V/m is exceeded. It has been pointed out that the cause of this is a phenomenon in which electric field strength is intensified owing to the presence of very small protrusions at projections or corners. Accordingly, in the case of the present invention as well, it is preferred that the maximum electric field strength be held below $1\times10^7$ V/m within the limits of currently utilizable mass-production manufacturing techniques. Of course, by using a spacer fabricated very carefully, it is possible to achieve operation in the region of $1\times10^9$ V/m without producing an electric discharge.

In the foregoing embodiments, the spacer used has the shape of a rectangular parallelepiped whose surfaces form angles of 90° at the edges. However, the effects of the low-resistance film 1020*c* according to the present invention manifest themselves in a case where the spacer has such a shape that angles of approximately 150° or less are formed at the edges defined by the side faces. Accordingly, the invention is applicable also to spacers having the shape of a regular hexagonal prism or regular octagonal prism.

The present embodiment will now be described in further detail given examples of apparatus.

In the embodiment described below, the multiple. electron beam source used was obtained by wiring N×M (N=3072, M=1024) surface-conduction emission elements, which have electron emission portions on a film of conductive fine particles between electrodes, in the form of a simple matrix (see FIGS. 1 and 2) by M row-direction wiring patterns and N column-direction wiring patterns.

A silicon nitride film was formed by sputtering to a thickness of 0.5 μm on the surface of glass consisting of the same material as the rear plate and having a length of 20 mm, a width of 5 mm and a thickness of 0.2 mm. The resulting body was adopted as the insulating member 1020*a*. A film obtained by building up a film of a Cr—Al alloy nitride and a chrome oxide film formed on the film surface of the first-mentioned film was used as the high-resistance film. The thicknesses of these films were 200 nm and 5 nm, respectively. The high-resistance film of the present invention is not limited to this example.

Next, Au films each having a thickness of 0.1 μm were formed as the low-resistance films. The films were formed as strips of equal width H (=30 μm) lying parallel to the connections to the side of the face plate and to the side of the rear plate (i.e., to the surface of the row-direction wiring pattern 1013 and to the surface of the metal back 1019) but not on the end portions of the spacer (see FIGS. 15A and 15 B).

Figure 24A:
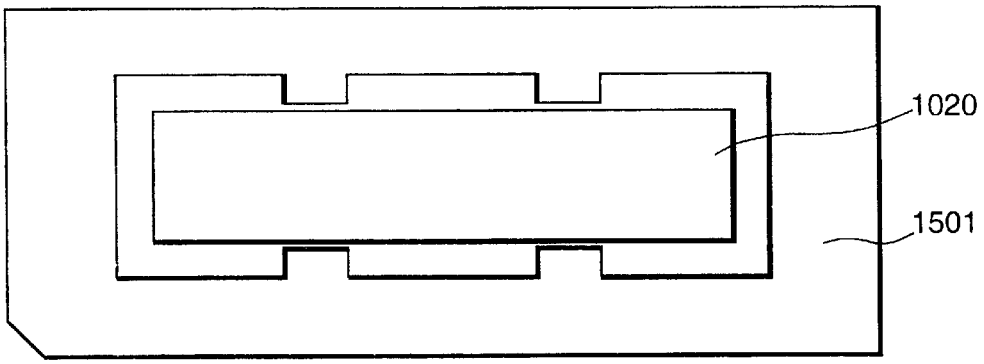
FIGS. 24A and 24B are diagrams useful in describing a method of fabricating the low-resistance film according to the embodiment.
Figure 24B:
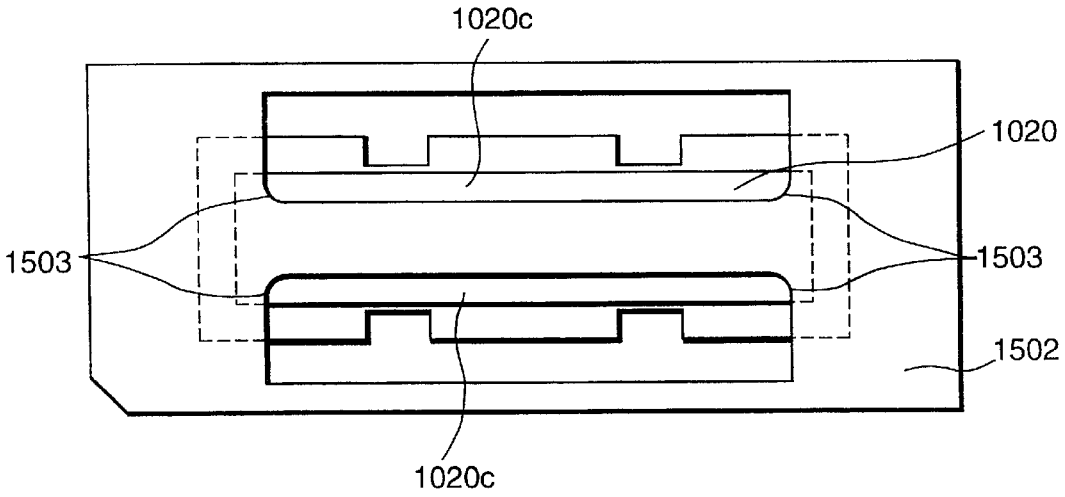

FIGS. 24A and 24B are diagrams useful in describing a method of fabricating the low-resistance film 1020*c* of the spacer 1020.

The spacer 1020 was placed in a subordinate mask 1501 having projections that abut against the long sides of the spacer (see FIG. 24A), after which a mask 1502 is disposed so as to cover the spacer 1020.

The mask 1502 was formed into a pattern so as to expose the spacer 1020 at portions corresponding to the low-resistance films 1020*c* of the desired shape. In particular, areas 1503 corresponding to the end portions of the low-resistance films 1020*c* was provided with a prescribed radius of curvature. Since the radius of curvature is several microns or more, it is possible to form the films using an ordinary etching method or the like. In regard to a mask used below in a second embodiment, described later, a mask fabricated by the same manufacturing process can be used. The low-resistance films 1020*c* were fabricated using a sputtering method with the set-up described above.

Another method of fabrication that can be used includes removing the end portions of the low-resistance films 1020*c*, which have been fabricated by sputtering, by irradiating these portions with a high-power laser beam, thereby obtaining the desired shape. In a case where a relative positional offset occurs between the spacer 1020 and the mask 1502 and, as a result, the low-resistance films are formed so as intersect the side end faces of the spacer, this method makes it possible to remove the unwanted portions so that intensification of the electric field can be prevented.

The end portions of the strip-shaped low-resistance films 1020*c* are placed so as to be situated 20 μm short of the end faces of the spacer (1=20 μm FIG. 15B). The edges at both end portions A of the low-resistance films 1020*c* have a radius r of 20 μm and are smoothly connected to a linear portion B. This prevents the occurrence of a discharge when a high voltage is impressed across the face plate and rear plate. It should be noted that the position of the end portion of the low-resistance film 1020*c* should fall within a range in which the paths of electrons emitted from the element will not be affected. Further, the radius r at the corners is not limited to the size mentioned in this embodiment and the earlier described size may be applied.

The spacer is connected to the row-direction wiring pattern and to the metal back on the face plate using electrically conductive frit glass. The conductive frit glass is a mixture of conductive fine particles the surface of which is coated with metal. The frit glass electrically connects the charging preventing film on the surface of the spacer with the row-direction wiring pattern or face plate.

A display panel having the spacers 1020 shown in FIG. 1 was fabricated according to this embodiment. The details will be described with reference to FIGS. 1 and 5.

First, the substrate 1011 was fixed to the rear plate 1015. The row-direction wiring patterns 1013, column-direction wiring patterns 1014, inter-electrode insulation layer (not shown) and the element electrodes and conductive thin film of the surface-conduction emission elements were formed on the substrate 1011 in advance. Next, spacers 1020, which were obtained by forming the high-resistance film 1020*b* (described later) on the surface of the insulating member 1020*a* (consisting of soda lime glass) exposed to the interior of the hermetic envelope, and forming the low-resistance films 1020*c* as conductive films on the abutting end faces, were secured to the row-direction wiring patterns 1013 of the substrate 1011 at equal intervals and in parallel therewith. Each spacer 1020 had a height of 5 mm, a thickness of 200 μm and a length of 20 mm.

The face plate 1017 having the phosphor film 1018 and metal back 1019 provided on its inner side was placed 5 mm above the substrate 1011 via the intermediary of side walls 1016, and the joints between the rear plate 1015, face plate 1017 and side wall 1016 as well as the joints between the rear plate 1015, face plate 1017 and the spacers 1020 were fixed. The joint between the substrate 1011 and rear plate 1015, the joint between the rear plate 1015 and side wall 1016 and the joint between fac e pla te 1017 and side wall 1016 were coated with frit glass (not shown) and the joints were sealed by carrying out calcination in the atmosphere at a temperature of 400~500° C. for 10 min or more.

The spacers 1020 were bonded in place and electrically connected by placing them on the row-direc tion wiring patterns 1013 (of width 300 μm, for example) on the side of the substrate 1011 and on the metal back 1019 on the side of the face plate 1017 via conductive frit glass (not shown) mixed a co nductive filler or with a conductive material such as metal, and carrying out calcination in the atmosphere at a temperature of 400~500° C. for 10 min or more at the same time as the above-mentioned sealing of the hermetic envelope.

Figure 16:
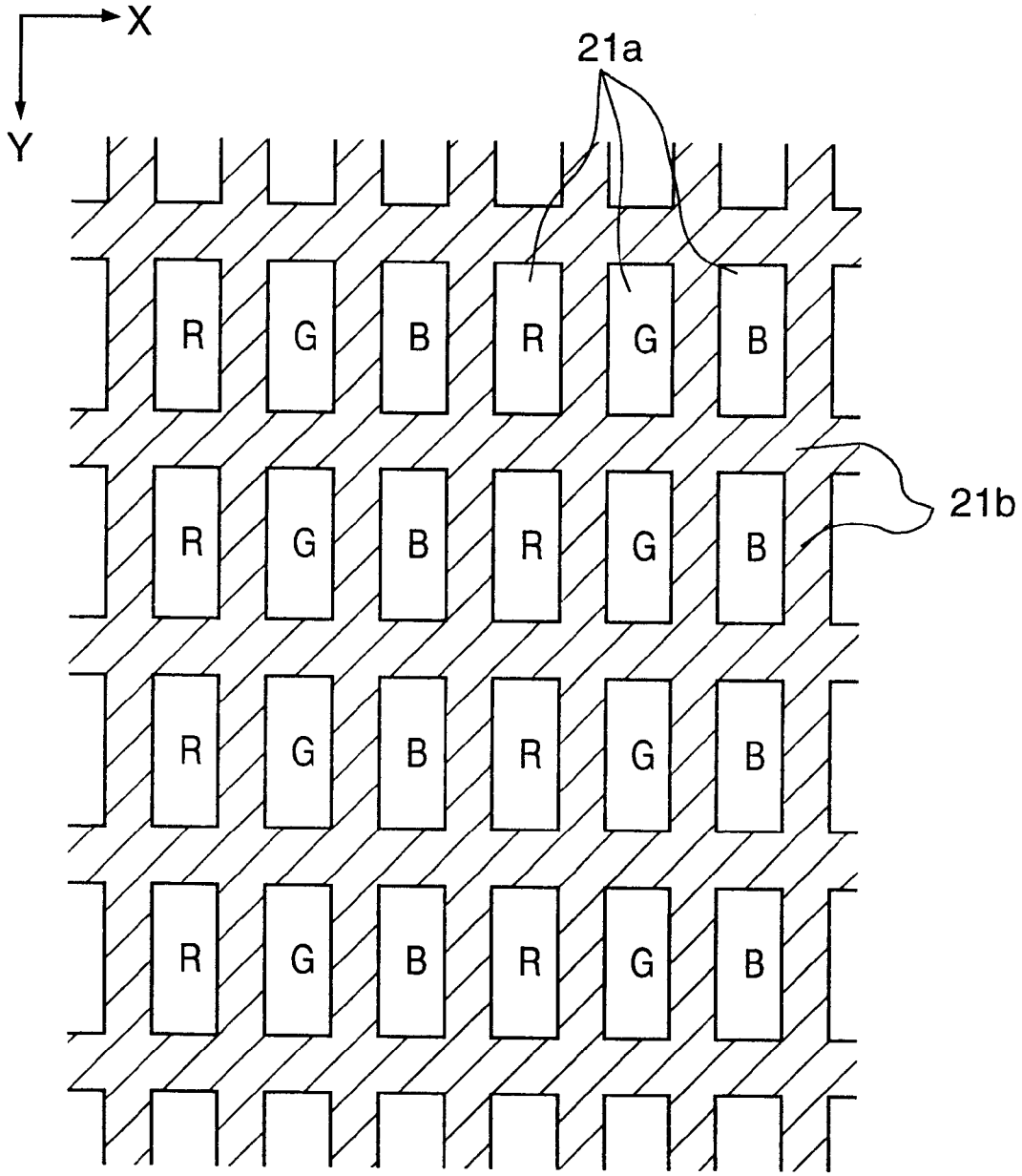
FIG. 16 is a diagram useful in describing the pattern of a phosphor film.
Figure 17:
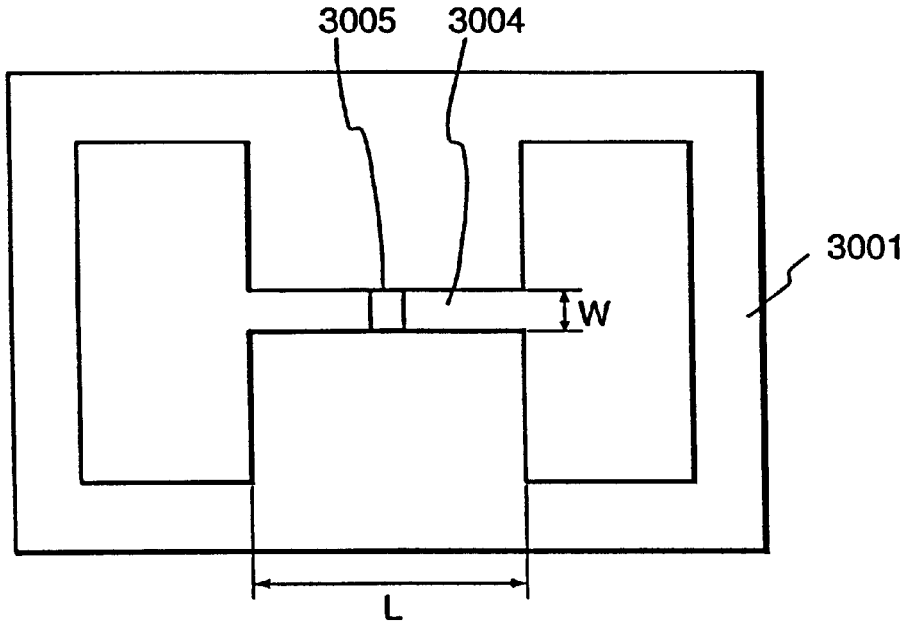
FIG. 17 PRIOR ART
FIG. 17 is a plan view showing an element according to M. Hartwell et al.
Figure 18:
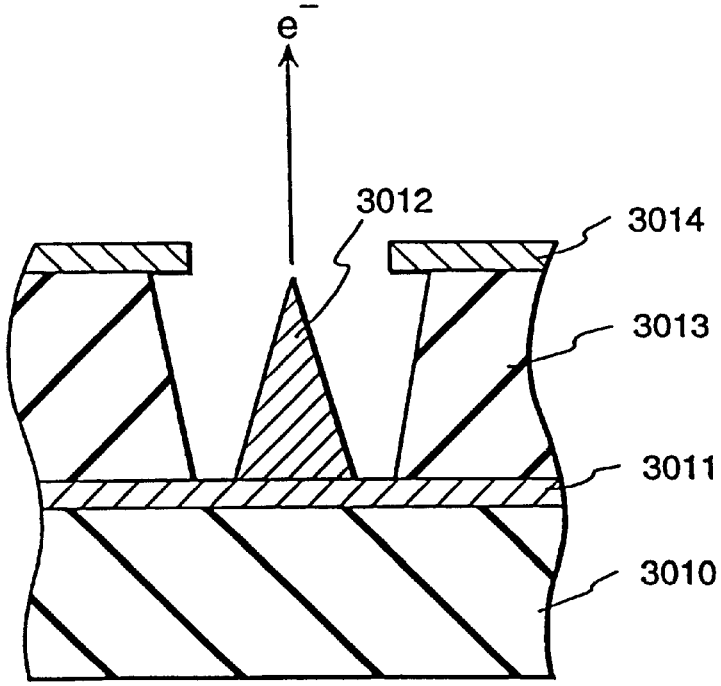
FIG. 18 PRIOR ART
FIG. 18 is a sectional view showing an element according to C. A. Spindt et al.
Figure 19:
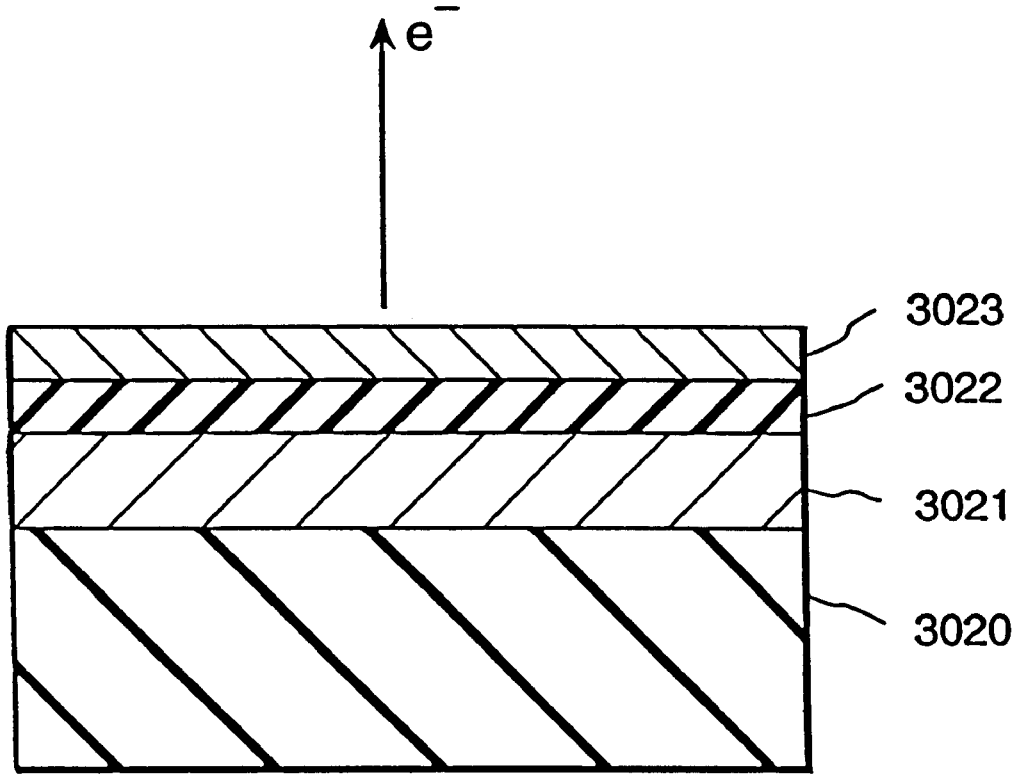
FIG. 19 PRIOR ART
FIG. 19 is a diagram illustrating a typical example of a MIM-type element construction.
Figure 20:
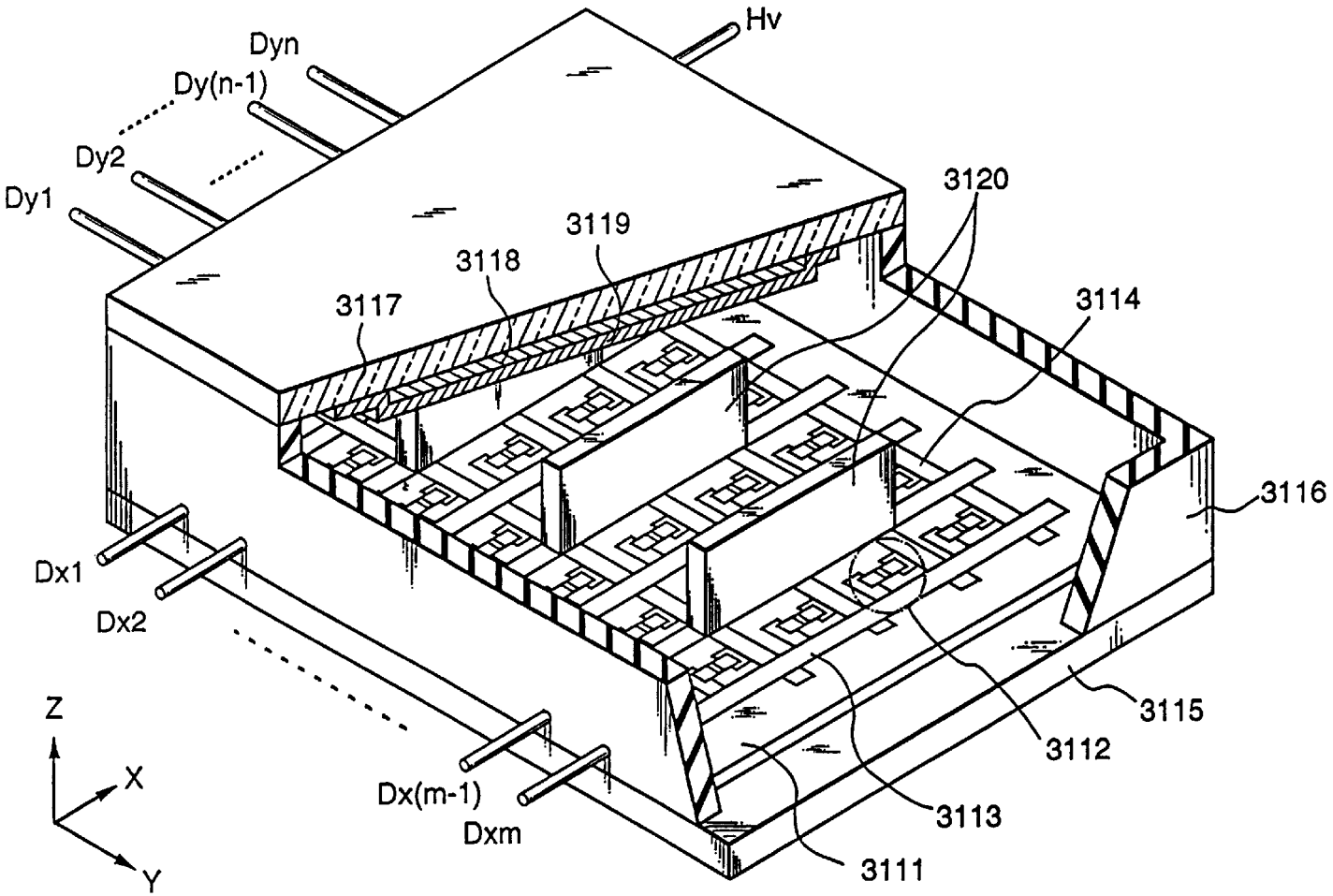
FIG. 20 PRIOR ART
FIG. 20 is a perspective view showing an example of a display panel constituting a flat-type image display apparatus.

The phosphor film 1018 used in this embodiment is as shown in FIG. 16. Specifically, the phosphor film has a striped shape in which color phosphors of the colors R (red), G (green) and B (blue) extending the column (Y) direction. A black conductor 21*b* is disposed so as to separate not only the color phosphors (R, G, B) 21 but also the pixels in the Y direction. The spacers 1020 were placed, via the intermediary of the metal back 1019, on the areas (of width 300 μm) of the black conductors 21*b* lying parallel to the row (X) direction. When the above-mentioned sealing is carried out, the phosphors 21*a* of each color and the elements placed on the substrate 1011 must be made to correspond. For this reason the rear plate 1015, face plate 1017 and spacers 1020 were positioned correctly.

The hermetic envelope completed as set forth above was evacuated through an exhaust pipe (not shown) by means of a vacuum pump, whereby a sufficient degree of vacuum was obtained. The elements were then supplied with current via the external terminals Dx1~Dxm, Dy1~Dyn and the row-direction wiring patterns 1013 and column-direction wiring patterns 1014 to perform the above-described electrification forming and electrification activation treatments, whereby a multiple electron beam source was manufactured.

The exhaust pipe (not shown) was heated by a gas burner in a vacuum of $1\times10^{-6}$ torr to fuse the pipe and seal the envelope. A getter treatment was then applied in order to maintain the degree of vacuum after the sealing of the envelope.

In this completed image display apparatus using the display panel of the kind shown in FIGS. 1 and 5, electrons were emitted by applying scanning signals and modulating signals to the cold cathode elements (surface-conduction emission elements) 1012 via the external terminals Dx1~Dxm, Dy1~Dyn, respectively, from signal generating means (not shown), and the emitted electron beams were accelerated by applying a high voltage to the metal back 1019 through the high-voltage terminal Hv. The electrons bombarded the phosphor film 1018 to excite the color phosphors 21*a* (R, G, B in FIG. 16) into emitting light, whereby an image was displayed. The voltage Va applied to the high-voltage terminal Hv was made 3 to 10 kV, and the voltage Vf applied to the wiring patterns 1013, 1014 was made 14 V.

At this time rows of equally spaced light-emission spots were formed in two dimensions. These included light-emission spots produced by emitted electrons from the cold cathode elements 1012 at positions in the vicinity of the spacers 1020. A clear color image display having excellent color reproducibility could be obtained. A disturbance in the electric field that would affect the electron paths did not occur despite the provision of the spacers 1020.

The following is a list of a plurality of experiments that were performed using the display panel shown in FIG. 1. The list shows the experimental parameters (G, r, Va, Emax) and whether or not discharge occurred under various conditions.

| Experiment | G (mm) | r (μm) | Va (kV) | Occurrence of Discharge |
|---|---|---|---|---|
| 1 | 5 | 20 | 3 | None |
| 2 | 5 | 20 | 10 | None |
| 3 | 5 | 2 | 3 | None |
| 4 | 5 | 2 | 10 | Rare |
| 5 | 2 | 20 | 3 | None |
| 6 | 2 | 20 | 10 | None |
| 7 | 2 | 2 | 3 | Rare |
| 8 | 2 | 2 | 10 | Reduced frequency of occurrence in comparison with right-angle end portion |
| 9 | 2 | 0.5 | 10 | Often (Example for comparison with invention) |

Figure 21:
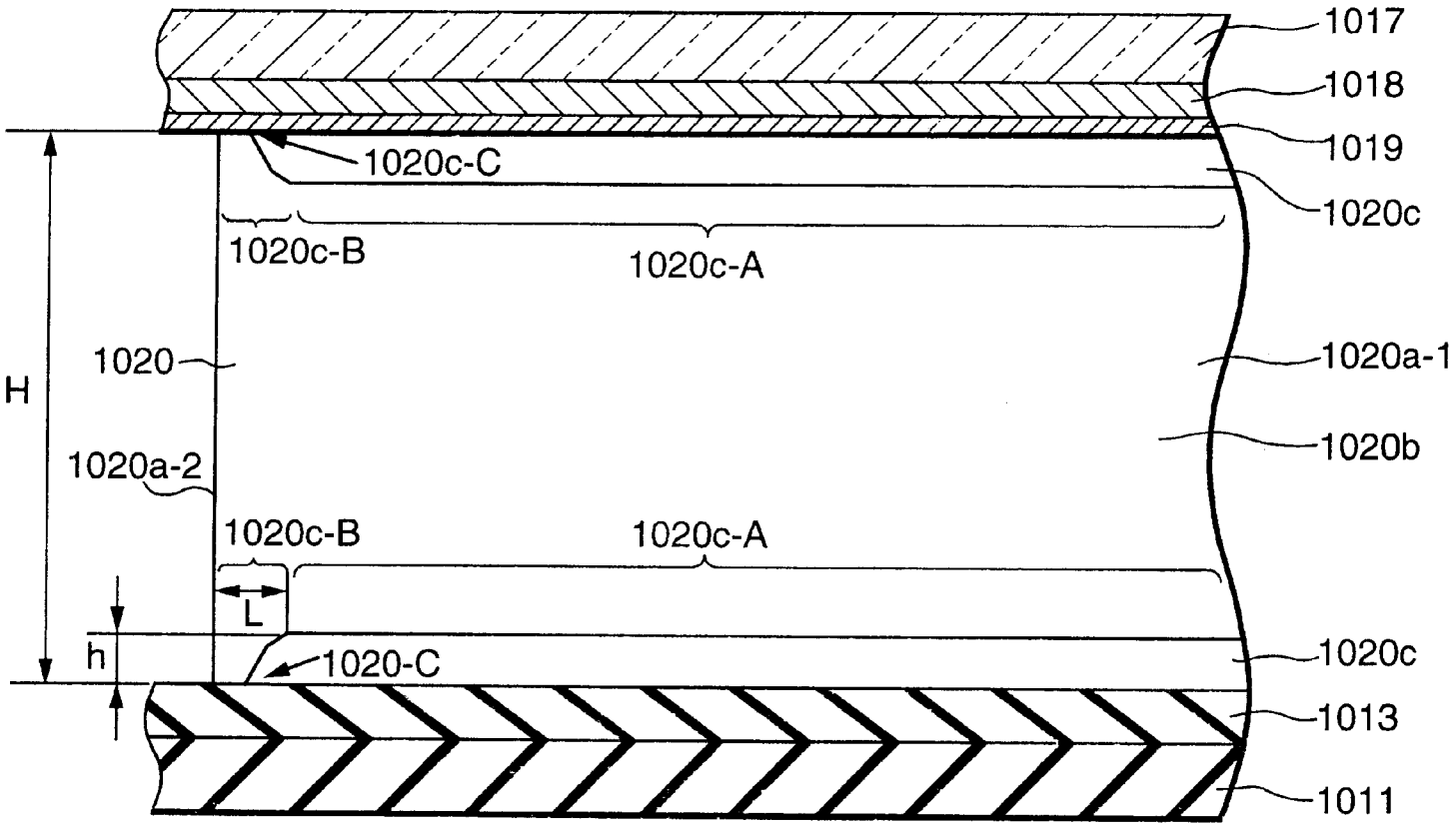
FIG. 21 is a diagram useful in describing the shape of a low-resistance film according to a second embodiment of the present invention.

FIG. 21 is a diagram showing the principal portions of a second embodiment of the present invention and is useful in describing the same.

As in the first embodiment, the spacer 1020 is placed between the substrate 1011 and face plate 1017 constructing an electron source. The spacer 1020 is obtained by forming the high-resistance film 1020*b* and low-resistance films 1020*c* on the surface of the insulating member 1020*a* (not shown in FIG. 21). In particular, the low-resistance films 1020*c* are formed on the surface of a side face 1020*a*-1 along the long sides of the insulating member 1020*a* and are electrically connected to the metal back 1019 on the face plate 1017 and to the row-direction wiring pattern 1013 on the substrate 1011. In FIG. 21, 1020*c*-A denotes linear portions of the low-resistance films 1020*c* that lie parallel to the face plate 1017 (the metal back 1019) and substrate 1011 (the row-direction wiring pattern 1013). Further, 1020*c*-B denotes end portions of the low-resistance films 1020*c* connected by a plurality of straight lines (three straight lines inclusive of the linear portions 1020*c*-A of the low-resistance films), which form obtuse angles with each other, in the vicinity (the area of length L) of side face 1020*a*-2 along the short side of the spacer 1020. The end portion 1020*c*-B on the side of substrate 1011 intersects the row-direction wiring pattern 1013 (at an intersection 1020*c*-C), and the end portion 1020*c*-B on the side of face plate 1027 intersects the metal plate 1019 (at an intersection 1020*c*-C).

In this embodiment, each low-resistance film end portion 1020*c*-B is constituted by a polygon comprising obtuse angles. However, by making the obtuse angles approximately 120° or greater, preferably 150° or greater the effect of mitigating the concentration of electric field at the low-resistance film end portions 1020*c*-B can be obtained in the same manner as in the case where the low-resistance film end portion 1020*c*-B was formed by a smooth curve used in the first embodiment.

Figure 22:
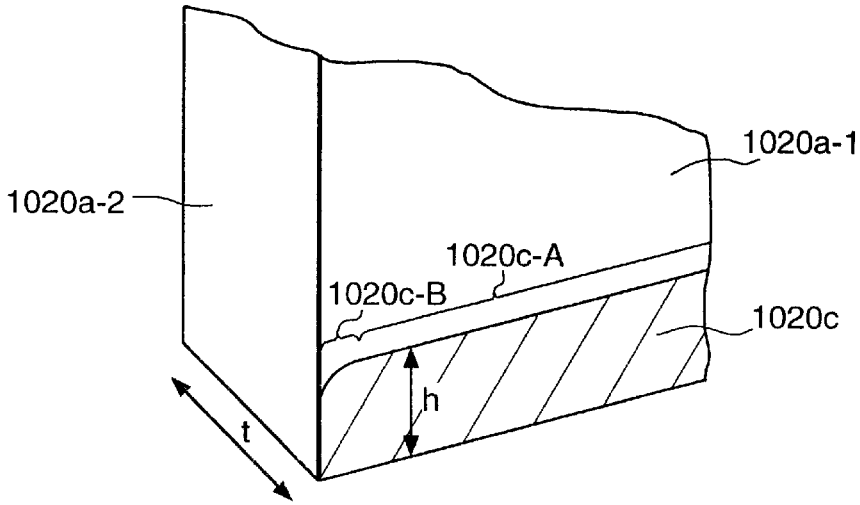
FIG. 22 is a diagram useful in describing the shape of a low-resistance film according to a third embodiment of the present invention.

FIG. 22 is a diagram showing the principal portions of a third embodiment of the present invention and is useful in describing the same.

This embodiment differs from the first and second embodiments in that the low-resistance film end portion 1020*c*-B formed on the side face 1020*a*-1 of the long side of the spacer 1020 is extended so as to contact the side face 1020*a*-2 on the short side of the spacer 1020. This arrangement makes it possible to minimize a difference in influence upon the spacer 1020 in terms of the electric field received by the emitted electrons from the electron emission elements 1012 near the low-resistance film linear portions 1020*c*-A and the electric field received by the emitted electrons from the electron emission elements 1012 near the low-resistance film end portions 1020*c*-B. It is especially helpful if the thickness t of the spacer 1020 in the transverse direction is equal to or less than the height h of the low-resistance film 1020*c*. In this arrangement, it is preferred that the end portions of the insulating member 1020*a* of spacer 1020 not be susceptible to chipping. A material which can be used for the insulating member is a ceramic having a high mechanical strength.

Figure 23:
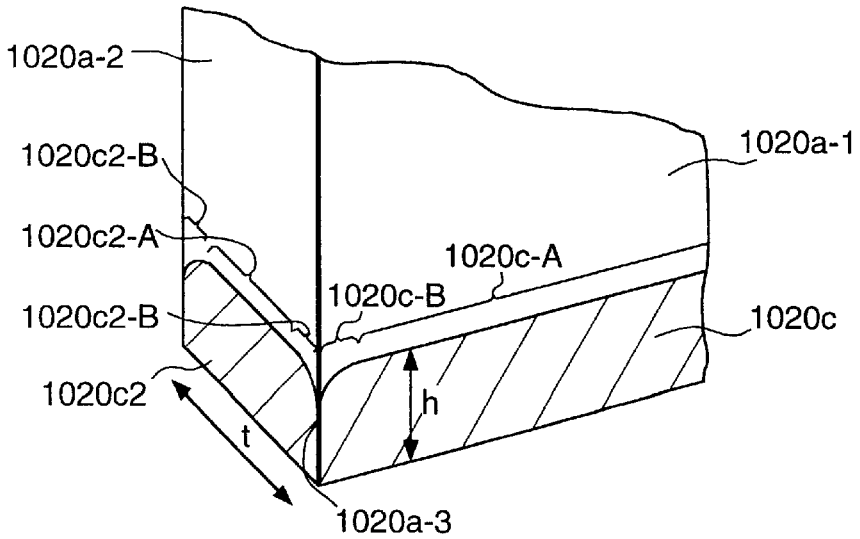
FIG. 23 is a diagram useful in describing the shape of a low-resistance film according to a fourth embodiment of the present invention.

FIG. 23 is a diagram showing the principal portions of a fourth embodiment of the present invention and is useful in describing the same.

This embodiment differs from the first through third embodiments in that a low-resistance film 1020*c*2 is formed also on the side face 1020*a*-2 on the short side of the spacer 1020. The low-resistance film 1020*c*2 comprises a linear portion 1020*c*2-A and end portions 1020*c*2-B. The end portions 1020*c*2-B may have a curved shape as in the first embodiment or a polygonal shape as in the second embodiment. Further, these may be extended to edges 1020*a*-3 defined by the long side face 1020*a*-1 and short side face 1020*a*-2 of the insulating member 1020*a*. By virtue of this arrangement, a recess in the low-resistance film is formed at the boundary between the low-resistance films 1020*c*, 1020*c*2 in the vicinity of the edge 1020*a*-3 defined by the long side face 1020*a*-1 and short side face 1020*a*-2. As a result, a concave equipotential surface is formed in the direction of the high-resistance film 1020*b*. This makes it possible to prevent the formation of a convex equipotential surface in the direction of the high-resistance film 1020*b* in the vicinity of the edge 1020*a*-3. It is especially helpful if the thickness t of the spacer 1020 in the transverse direction is equal to or less than the height h of the low-resistance film 1020*c*.

In the embodiment, the low-resistance film 1020*c* is formed both on the side of the face plate 1017 and on the side of the substrate 1011 constituting the electron source. However, the effect of mitigating the concentration of electric field and suppressing discharge can be obtained when the arrangement of the end portion 1020*c*-B of the low-resistance film of this invention is used either on the side of the face plate 1017 or on the side of the substrate 1011 constituting the electron source. The effect is great if the arrangement of the low-resistance film 1020*c* of this embodiment is used on the side of the substrate 1011 constituting the electron source on the low-potential side. Further, the effect is especially great if the arrangement of the low resistance film 1020*c* of this embodiment is used both on the side of the face plate 1017 and on the side of the substrate 1011 constituting the electron source. Accordingly, such arrangement is especially preferable.

The image display apparatus according to the embodiments of the present invention has the following advantages:

1) Charging of the spacer can be neutralized because the surface of the spacer has a high-resistance film electrically connected to the substrate and phosphor film. Further, a low-resistance film made of metal or the like is disposed over the major part of the portion where the high-resistance film is connected to the element substrate or where the high-resistance film is connected to the image forming member, thereby allowing a stabilized supply of current. This makes it possible to prevent charging and a shift in light-emitting positions.

2) Concentration of electric field can be suppressed by providing the low-resistance film with an external shape that is a straight line, a curve having a large curvature, obtuse angles or a combination of these shapes. As a result, it is possible to apply a higher voltage across the phosphor film and element substrate while suppressing discharge.

3) As a result of the foregoing, it is possible to provide an image forming apparatus that presents an excellent image of improved brightness due to application of higher voltage, wherein the image does not exhibit any shift in light-emitting positions.

The present invention makes it possible to reduce the occurrence of discharge greatly while maintaining a satisfactory charging preventing effect in an image forming apparatus, particularly in the spacers thereof.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

an envelope;

an electron source disposed within said envelope;

an image forming member for forming an image by irradiation with electrons emitted by said electron source within said envelope;

electrodes within said envelope, to which mutually different voltages are applied;

a spacer disposed between said electrodes; and conductive layers provided on said spacer, said conductive layers having a resistance lower than that of said spacer, wherein, said spacer has conductivity and is electrically connected to the electrodes via said conductive layers, at least one of said conductive layers has an end portion defining a shape which is a combination of a linear portion and a curved portion or a combination of a linear portion and an obtuse-angle portion, and a surface of said spacer has a sheet resistance of $1\times10^5$ Ω/□ or greater.

2. The apparatus according to claim 1, wherein said spacer comprises an insulating member and a conductive film covering the surface of said insulating member.

3. The apparatus according to claim 2 wherein each of said conductive layers has a sheet resistance less that than of said conductive film.

4. The apparatus according to claim 2, wherein said insulating member consists of a material the same as that constituting said envelope.

5. The apparatus according to claim 2, wherein said conductive film has a sheet resistance of $1\times10^5$ Ω/□ or greater.

6. The apparatus according to claim 5, wherein said conductive film has a sheet resistance of $1\times10^{12}$ Ω/□ or less.

7. The apparatus according to claim 1, wherein said spacer provides resistance against atmospheric pressure.

8. The apparatus according to claim 1, wherein said electron source has a plurality of electron emission elements connected by wiring, and said spacer is electrically connected to said wiring.

9. The apparatus according to claim 8, wherein said electron emission elements are cold cathode elements.

10. The apparatus according to claim 9, wherein said cold cathode elements are surface-conduction electron emission elements.

11. The apparatus according to claim 1, wherein said image forming member has an accelerating electrode for accelerating electrons emitted by said electron source, and said spacer is electrically connected to said accelerating electrode.

12. The apparatus according to claim 1, wherein said image forming member has phosphors and an accelerating electrode for accelerating electrons emitted by said electron source, and said spacer is electrically connected to said accelerating electrode.

13. The apparatus according to claim 1, wherein said spacer is a plate-shaped spacer.

14. An image forming apparatus comprising:

an envelope;

an electron source disposed within said envelope;

an image forming member for forming an image by irradiation with electrons emitted by said electron source within said envelope;

electrodes within said envelope, to which mutually different voltages are applied;

a spacer disposed between said electrodes, said spacer having conductivity and being electrically connected to the electrodes via conductive layers;

wherein, at least one of said conductive layers has an end portion defining a shape which is a combination of a linear portion and a curved portion or a combination of a linear portion and an obtuse-angle portion, and said spacer is polygonal in shape and each of said conductive layers is such that the edge portion defines a shape which is a curve or an obtuse angle in the vicinity of a corner of said spacer.

15. An image forming apparatus comprising:

an envelope;

an electron source disposed within said envelope;

an image forming member for forming an image by irradiation with electrons emitted by said electron source within said envelope;

electrodes within said envelope, to which mutually different voltages are applied;

a spacer disposed between said electrodes, said spacer having conductivity and being electrically connected to the electrodes via conductive layers;

wherein, at least one of said conductive layers has an end portion defining a shape which is a combination of a linear portion and a curved portion, and said curved portion has a radius of curvature of 1 $\mu$m or greater.

16. An image forming apparatus comprising:

an envelope;

an electron source disposed within said envelope;

an image forming member for forming an image by irradiation with electrons emitted by said electron source within said envelope;

electrodes within said envelope, to which mutually different voltages are applied;

a spacer disposed between said electrodes, said spacer having conductivity and being electrically connected to the elect rodes via conductive layers;

wherein, at least one of said conductive layers has an end portion defining a shape which is a combination of a linear portion and a curved portion or a combination of a linear portion and an obtuse-angle portion, said spacer comprises an insulating member and a conductive film covering the surface of said insulating member, and said conductive film has a sheet resistance of $1\times10^5$ to $1\times10^{12}$ $\Omega/\square$.

17. An image forming apparatus comprising:

an envelope;

an electron source disposed within said envelope;

an image forming member for forming an image by irradiation with electrons emitted by said electron source within said envelope;

electrodes within said envelope, to which mutually different voltages are applied;

a spacer disposed between said electrodes, said spacer having conductivity and being electrically connected to the electrodes via conductive layers;

wherein, at least one of said conductive layers has an end portion defining a shape which is a combination of a linear portion and a curved portion or a combination of a linear portion and an obtuse-angle portion, said electron source comprises a plurality of electron emission elements wired in the form of a matrix by a plurality of row-direction wiring patterns and a plurality of column-direction wiring patterns, and said spacer is placed on said row-direction wiring patterns or on said column-direction wiring patterns and is electrically connected thereto.

18. The apparatus according to claim 17, wherein said electron emission elements are cold cathode elements.

19. The apparatus according to claim 18, wherein said cold cathode elements are surface-conduction electron emission elements.

* * * * *

UNITED STATES PATENT AND TRADEMARK OFFICE

CERTIFICATE OF CORRECTION

PATENT NO. : 6,278,233 B1
DATED : August 21, 2001
INVENTOR(S) : Sanou et al.

It is certified that error appears in the above-identified patent and that said Letters Patent is hereby corrected as shown below:

Title page,
Item [54], the title should read -- IMAGE FORMING APPARATUS WITH SPACER HAVING CONDUCTIVE LAYERS OF SPECIFIED SHAPE --.
Below Item [73], insert:
-- [*] Notice: This patent issued on a continued prosecution application filed under 37 CFR 1.53(d), and is subject to the twenty year patent term provisions of 35 U.S.C. 154(a)(2). --.

Column 1,
Line 20, "There" should read -- There are --; and
Line 53, "In" should read -- In the --.

Column 4,
Line 53, "is" (second occurrence) should read -- in --.

Column 5,
Line 66, "an" (second occurrence) should read -- a --.

Column 7,
Line 26, "an" should be deleted.

Column 8,
Line 4, "display." should read -- display --.

Column 11,
Line 23, "controls" should read -- control --.

Column 13,
Line 15, "pump, not shown," should read -- pump (not shown), --.

Column 14,
Line 12, "used" should read -- use --.

Column 15,
Line 59, "surrounding." should read -- surrounding --.

Column 21,
Line 15, "these" should read -- of these --; and
Line 18, "Dx1~Dyn" should read -- Dy1~Dyn --.

Column 22,
Line 22, "Dx1~Dyn" should read -- Dy1~Dyn --; and
Line 49, "voltage," should read -- voltage --.

UNITED STATES PATENT AND TRADEMARK OFFICE

CERTIFICATE OF CORRECTION

PATENT NO. : 6,278,233 B1
DATED : August 21, 2001
INVENTOR(S) : Sanou et al.

It is certified that error appears in the above-identified patent and that said Letters Patent is hereby corrected as shown below:

Column 23,
Line 29, “Dx1~Dyn” should read -- Dy1~Dyn --.

Column 24,
Line 7, “of a” should read -- of --.

Column 25,
Line 46, “areas” should read -- area --; and
Line 61, “so as” should read -- so as to --.

Column 26,
Line 44, “fac e pla te” should read -- face plate --;
Line 49, “row-direc tion” should read -- row-direction --; and
Line 53, “co nductive” should read -- conductive --.

Column 30,
Line 20, “less that than” should read -- less than that --.

Column 31,
Line 36, “elect rodes” should read -- electrodes --.

Signed and Sealed this

Twenty-fourth Day of June, 2003

JAMES E. ROGAN
*Director of the United States Patent and Trademark Office*